US010047568B2

(12) United States Patent
Mukhopadhyay et al.

(10) Patent No.: US 10,047,568 B2
(45) Date of Patent: Aug. 14, 2018

(54) POLYCRYSTALLINE DIAMOND COMPACTS, AND RELATED METHODS AND APPLICATIONS

(71) Applicant: US SYNTHETIC CORPORATION, Orem, UT (US)

(72) Inventors: Debkumar Mukhopadhyay, Sandy, UT (US); Kenneth E. Bertagnolli, Riverton, UT (US); Cody William Knuteson, Salem, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 614 days.

(21) Appl. No.: 14/677,875

(22) Filed: Apr. 2, 2015

(65) Prior Publication Data

US 2015/0211306 A1 Jul. 30, 2015

Related U.S. Application Data

(63) Continuation-in-part of application No. 14/086,283, filed on Nov. 21, 2013, now Pat. No. 9,765,572, and
(Continued)

(51) Int. Cl.
*E21B 10/567* (2006.01)
*E21B 10/573* (2006.01)
(Continued)

(52) U.S. Cl.
CPC ..... *E21B 10/567* (2013.01); *B22F 7/06* (2013.01); *B24D 3/10* (2013.01); *B24D 18/0009* (2013.01);
(Continued)

(58) Field of Classification Search
CPC ..... B22F 2998/10; B22F 2999/00; B22F 2003/244; B22F 2207/01; B22F 3/14;
(Continued)

(56) References Cited

U.S. PATENT DOCUMENTS 3,935,034 A 1/1976 Hayes
4,224,380 A 9/1980 Bovenkerk et al.
(Continued)

FOREIGN PATENT DOCUMENTS

EP 1079063 2/2001
EP 1149937 10/2001
(Continued)

OTHER PUBLICATIONS

Notice of Allowance for U.S. Appl. No. 14/086,283 dated May 24, 2017.
(Continued)

*Primary Examiner* — James G Sayre
(74) *Attorney, Agent, or Firm* — Dorsey & Whitney LLP

(57) ABSTRACT

Embodiments relate to polycrystalline diamond compacts ("PDCs") including a polycrystalline diamond ("PCD") table in which a metal-solvent catalyst is alloyed with at least one alloying element to improve thermal stability and/or wear resistance of the PCD table. In an embodiment, a PDC includes a substrate and a PCD table bonded to the substrate. The PCD table includes diamond grains defining interstitial regions. The PCD table includes an alloy comprising at least one Group VIII metal and at least one metallic alloying element such as phosphorous.

46 Claims, 23 Drawing Sheets

Related U.S. Application Data a continuation-in-part of application No. 14/304,631, filed on Jun. 13, 2014, now Pat. No. 9,945,186.

(51) Int. Cl.

| | |
|---|---|
| ***B24D 18/00*** | (2006.01) |
| ***E21B 10/55*** | (2006.01) |
| ***B24D 3/10*** | (2006.01) |
| ***C22C 26/00*** | (2006.01) |
| ***B22F 7/06*** | (2006.01) |

(52) U.S. Cl.

CPC ..... *C22C 26/00* (2013.01); *E21B 10/55* (2013.01); *E21B 10/5735* (2013.01); *B22F 2998/10* (2013.01); *B22F 2999/00* (2013.01)

(58) Field of Classification Search

CPC .. B22F 7/06; C22C 26/00; C22C 1/05; B24D 18/0009; B24D 3/10; E21B 10/55; E21B 10/567; E21B 10/5735

See application file for complete search history.

(56) References Cited

U.S. PATENT DOCUMENTS

| | | | |
|---|---|---|---|
| 4,268,276 | A | 5/1981 | Bovenkerk |
| 4,274,900 | A | 6/1981 | Mueller et al. |
| 4,410,054 | A | 10/1983 | Nagel et al. |
| 4,468,138 | A | 8/1984 | Nagel |
| 4,560,014 | A | 12/1985 | Geczy |
| 4,738,322 | A | 4/1988 | Hall et al. |
| 4,811,801 | A | 3/1989 | Salesky et al. |
| 4,907,377 | A | 3/1990 | Csillag et al. |
| 4,913,247 | A | 4/1990 | Jones |
| 5,016,718 | A | 5/1991 | Tandberg |
| RE33,767 | E | 12/1991 | Christini et al. |
| 5,092,687 | A | 5/1992 | Hall |
| 5,120,327 | A | 6/1992 | Dennis |
| 5,127,923 | A | 7/1992 | Bunting et al. |
| 5,135,061 | A | 8/1992 | Newton, Jr. |
| 5,154,245 | A | 10/1992 | Waldenstrom et al. |
| 5,364,192 | A | 11/1994 | Damm et al. |
| 5,368,398 | A | 11/1994 | Damm et al. |
| 5,460,233 | A | 10/1995 | Meany et al. |
| 5,480,233 | A | 1/1996 | Cunningham |
| 5,544,713 | A | 8/1996 | Dennis |
| 5,759,216 | A | 6/1998 | Kanada et al. |
| 6,261,329 | B1 | 7/2001 | Ogata et al. |
| 6,338,754 | B1 | 1/2002 | Cannon et al. |
| 6,541,115 | B2 | 4/2003 | Pender et al. |
| 6,793,681 | B1 | 9/2004 | Pope et al. |
| 7,353,893 | B1 | 4/2008 | Hall et al. |
| 7,473,287 | B2 | 1/2009 | Belnap et al. |
| 7,635,035 | B1 | 12/2009 | Bertagnolli et al. |
| 7,647,993 | B2 | 1/2010 | Middlemiss |
| 7,726,421 | B2 | 6/2010 | Middlemiss |
| 7,866,418 | B2 | 1/2011 | Bertagnolli et al. |
| 7,950,477 | B1 | 5/2011 | Bertagnolli et al. |
| 7,998,573 | B2 | 8/2011 | Qian et al. |
| 8,034,136 | B2 | 10/2011 | Sani |
| 8,069,935 | B1 | 12/2011 | Miess et al. |
| 8,080,071 | B1 | 12/2011 | Vail |
| 8,109,349 | B2 | 2/2012 | Hall et al. |
| 8,236,074 | B1 | 8/2012 | Bertagnolli et al. |
| 8,277,722 | B2 | 10/2012 | DiGiovanni |
| 8,727,045 | B1 | 5/2014 | Mukhopadhyay et al. |
| 2008/0219914 | A1 | 9/2008 | Smallman et al. |
| 2011/0030283 | A1 | 2/2011 | Cariveau et al. |
| 2011/0067929 | A1* | 3/2011 | Mukhopadhyay ..... B01J 3/062 175/432 |
| 2011/0083908 | A1 | 4/2011 | Shen et al. |
| 2012/0012402 | A1 | 1/2012 | Thigpen et al. |
| 2012/0152622 | A1 | 6/2012 | Sue et al. |
| 2012/0241226 | A1 | 9/2012 | Bertagnolli et al. |
| 2012/0261197 | A1 | 10/2012 | Miess et al. |
| 2012/0324801 | A1 | 12/2012 | Fang |
| 2012/0325565 | A1 | 12/2012 | Fang |
| 2013/0067826 | A1 | 3/2013 | Vaughn et al. |
| 2013/0068540 | A1 | 3/2013 | DiGiovanni |
| 2013/0068541 | A1 | 3/2013 | DiGiovanni |
| 2013/0092451 | A1 | 4/2013 | Mukhopadhyay et al. |
| 2013/0092452 | A1 | 4/2013 | Mukhopadhyay et al. |
| 2013/0180181 | A1 | 7/2013 | Nixon et al. |
| 2014/0047776 | A1 | 2/2014 | Scott et al. |
| 2014/0283457 | A1 | 9/2014 | Cariveau et al. |
| 2014/0318027 | A1 | 10/2014 | Sani et al. |
| 2015/0209745 | A1 | 7/2015 | Mukhopadhyay |
| 2015/0209937 | A1 | 7/2015 | Mukhopadhyay |

FOREIGN PATENT DOCUMENTS

| | | |
|---|---|---|
| GB | 376467 | 7/1932 |
| GB | 1496106 | 12/1977 |
| JP | 9254042 | 9/1997 |
| WO | WO 2008/062369 | 5/2008 |
| WO | WO 2008/074010 | 6/2008 |
| WO | WO 2012/139060 | 10/2012 |
| WO | WO 2012/173893 | 12/2012 |
| WO | 2013059063 A2 | 4/2013 |
| WO | WO 2013/092370 | 6/2013 |

OTHER PUBLICATIONS

Notice of Allowance for U.S. Appl. No. 14/677,821 dated Mar. 27, 2017.

International Search Report and Written Opinion from International Application No. PCT/US2015034900 dated Dec. 10, 2015.

Non-Final Office Action for U.S. Appl. No. 14/086,283 dated Aug. 24, 2016.

Non-Final Office Action for U.S. Appl. No. 14/677,821 dated Sep. 23, 2016.

Notice of Allowance for U.S. Appl. No. 14/677,859 dated Aug. 3, 2016.

Notice of Allowance received for U.S. Appl. No. 14/677,859 dated Nov. 21, 2016.

Restriction Requirement for U.S. Appl. No. 14/086,283 dated Apr. 15, 2016.

Restriction Requirement received for U.S. Appl. No. 14/304,631 dated Nov. 17, 2016.

U.S. Appl. No. 14/677,821, filed Apr. 2, 2015.

U.S. Appl. No. 14/677,859, filed Apr. 2, 2015.

U.S. Appl. No. 14/677,875, filed Apr. 2, 2015.

International Search Report and Written Opinion from International Application No. PCT/US2014/058121 dated Mar. 31, 2015.

Ishida et al. "The Co-P (Cobalt-Phosphorus) System" Bulletin of Alloy Phase Diagrams, ASM International, vol. 11, No. 6, Dec. 1, 1990, pp. 555-559.

Partial International Search Report from International Application No. PCT/US2015/034900 dated Sep. 29, 2015.

U.S. Appl. No. 12/555,715, filed Sep. 8, 2009, Miess et al.

U.S. Appl. No. 13/275,372, filed Oct. 18, 2011, Mukhopadhyay et al.

U.S. Appl. No. 13/751,405, filed Jan. 28, 2013, Gleason.

U.S. Appl. No. 14/086,283, filed Nov. 21, 2013, Knuteson et al.

U.S. Appl. No. 14/304,631, filed Jan. 13, 2014, Mukhopadhyay et al.

Ahmed, et al., "Chemical Vapor Deposition of Diamond Coatings onto Dental Burrs", Journal of Chemical Education, vol. 80, No. 6, Jun. 2003, pp. 636-641.

Cremer, et al. "Formation of intermetallic cobalt phases in the near surface region of cemented carbides for improved diamond layer deposition," Thin Solid Films 355-356 (2999) pp. 127-133.

Decker et al. "High-Pressure Calibration: A Critical Review," J. Phys. Chem. Ref. Data, 1, 3 (1972).

Guobiao, et al., "Boronizing mechanism of cemented carbides and their wear resistance," Int. Journal of Refractory Metals and Hard Materials, 41 (2013) pp. 351-355.

(56) References Cited

OTHER PUBLICATIONS

Rousse, et al. "Structure of the Intermediate Phase of PbTe at High Pressure," Physical Review B: Condensed Matter and Materials Physics, 71, 224116 (2005).
Non-Final Office Action for U.S. Appl. No. 14/304,631 dated Mar. 23, 2017.
Final Office Action for U.S. Appl. No. 14/086,283 dated Feb. 3, 2017.
Supplemental Notice of Allowance for U.S. Appl. No. 14/677,821 dated Apr. 27, 2017.
Supplemental Notice of Allowance received for U.S. Appl. No. 14/677,821 dated Apr. 14, 2017.
International Search Report and Written Opinion from International Application No. PCT/US2016/025586 dated Jul. 12, 2016.
Issue Notification for U.S. Appl. No. 14/062,283 dated Aug. 30, 2017.
Issue Notification for U.S. Appl. No. 14/677,821 dated Jul. 12, 2017.
Notice of Allowance for U.S. Appl. No. 14/304,631 dated Aug. 9, 2017.

* cited by examiner

POLYCRYSTALLINE DIAMOND COMPACTS, AND RELATED METHODS AND APPLICATIONS

CROSS-REFERENCE TO RELATED APPLICATIONS

This application is a continuation-in-part of U.S. application Ser. No. 14/086,283 filed on 21 Nov. 2013 and a continuation-in-part of U.S. application Ser. No. 14/304,631 filed on 13 Jun. 2014. The disclosure of each of the foregoing applications is incorporated, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a metal-solvent catalyst to promote intergrowth between the diamond particles, which results in formation of a matrix of bonded diamond grains having diamond-to-diamond bonding therebetween. Interstitial regions between the bonded diamond grains are occupied by the metal-solvent catalyst.

Despite the availability of a number of different PDCs, manufacturers and users of PDCs continue to seek PDCs with improved mechanical properties.

SUMMARY

Embodiments of the invention relate to PDCs including a PCD table in which at least one Group VIII metal thereof is alloyed with at least one alloying element to improve a thermal stability and/or a wear resistance of the PCD table. The disclosed PDCs may be used in a variety of applications, such as rotary drill bits, machining equipment, and other articles and apparatuses.

In an embodiment, a PDC is disclosed. The PDC includes a substrate and a PCD table bonded to the substrate. The PCD table includes an upper surface, at least one side surface, and an interfacial surface spaced from the upper surface and bonded to the substrate. The PCD table further includes a plurality of bonded diamond grains defining a plurality of interstitial regions; a first region extending inwardly from one or more of the upper surface or the at least one side surface; and a second region extending inwardly from the interfacial surface. The first region further includes an alloy disposed in at least a portion of the plurality of interstitial regions in the first region. The alloy includes at least one Group VIII metal and at least one metallic alloying element. For example, the at least one metallic alloying element may include phosphorous and the alloy may include at least one intermediate compound including the at least one Group VIII metal and the phosphorous, while the second region is substantially free of phosphorous and the alloy.

In an embodiment, a method of fabricating a PDC is disclosed. The method includes providing an assembly including a substrate and a PCD table bonded to the substrate. The PCD table includes an upper surface, at least one side surface, an interfacial surface bonded to the substrate, and a plurality of bonded diamond grains defining a plurality of interstitial regions. At least a portion of the plurality of interstitial regions includes at least one Group VIII metal disposed therein. The assembly includes at least one material positioned adjacent to the PCD table. For example, the at least one material may include phosphorous and/or or another at least one alloying element. The method includes subjecting the assembly to a heating process effective to at least partially melt the at least one alloying element of the at least one material and alloy the at least one Group VIII metal with the at least one alloying element to form an alloy. For example, when the at least one alloying element includes phosphorous, the alloy includes at least one intermediate compound including the at least one Group VIII metal and the phosphorous, and the PCD table including a first region extending inwardly from the upper surface and the at least one side surface that includes the at least one intermediate compound and a second region extending inwardly from the interfacial surface that is substantially free of phosphorous and the alloy.

Other embodiments include applications utilizing the disclosed PDCs in various articles and apparatuses, such as rotary drill bits, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

FIG. 3ZZ is an isometric view of an embodiment of a PDC after processing the precursor PDC assembly shown in FIG. 3Z.

DETAILED DESCRIPTION

Embodiments of the invention relate to PDCs including a PCD table in which at least one Group VIII metal thereof is alloyed with at least one alloying element to improve a thermal stability and/or a wear resistance of the PCD table. The disclosed PDCs may be used in a variety of applications, such as rotary drill bits, machining equipment, and other articles and apparatuses.

Figure 1A:
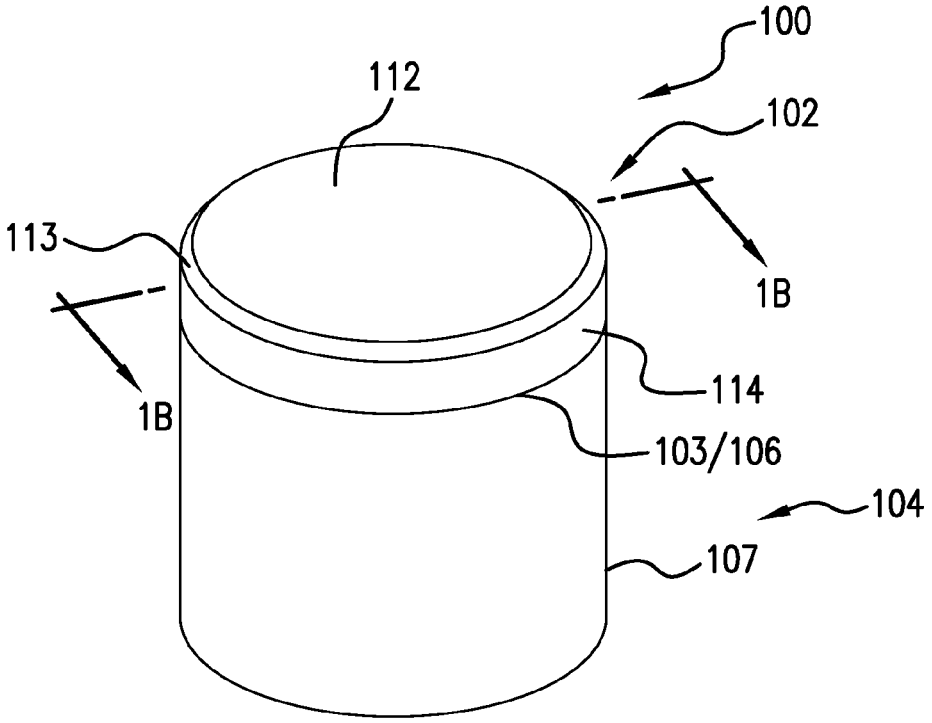
FIG. 1A is an isometric view of an embodiment of a PDC.
Figure 1B:
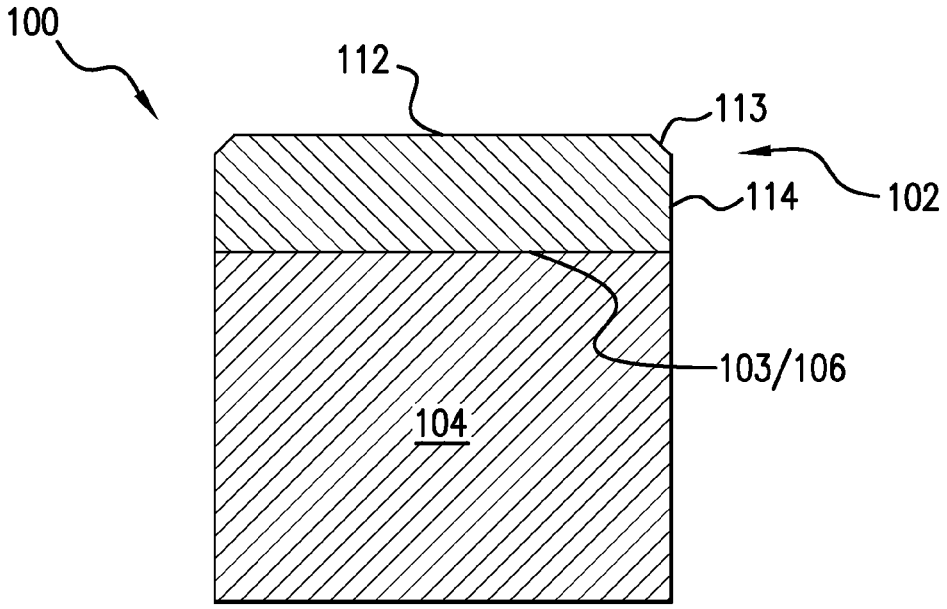
FIG. 1B is a cross-sectional view of the PDC shown in FIG. 1A taken along line 1B-1B thereof.

FIGS. 1A and 1B are isometric and cross-sectional views, respectively, of an embodiment of a PDC 100. The PDC 100 includes a PCD table 102 having an interfacial surface 103, and a substrate 104 having an interfacial surface 106 that is bonded to the interfacial surface 103 of the PCD table 102. The substrate 104 may comprise, for example, a cemented carbide substrate, such as tungsten carbide, tantalum carbide, vanadium carbide, niobium carbide, chromium carbide, titanium carbide, or combinations of the foregoing carbides cemented with iron, nickel, cobalt, or alloys thereof. In an embodiment, the cemented carbide substrate comprises a cobalt-cemented tungsten carbide substrate. While the PDC 100 is illustrated as being generally cylindrical, the PDC 100 may exhibit any other suitable geometry and may be non-cylindrical. Additionally, while the interfacial surfaces 103 and 106 are illustrated as being substantially planar, the interfacial surfaces 103 and 106 may exhibit complementary non-planar configurations.

The PCD table 102 may be integrally formed with the substrate 104. For example, the PCD table 102 may be integrally formed with the substrate 104 in an HPHT process by sintering of diamond particles on the substrate 104. The PCD table 102 further includes a plurality of directly bonded-together diamond grains exhibiting diamond-to-diamond bonding (e.g., $sp^3$ bonding) therebetween. The plurality of directly bonded-together diamond grains define a plurality of interstitial regions. For example, the diamond grains of the PCD table 102 may exhibit an average grain size of about less than 40 μm, about less than 30 μm, about 18 μm to about 30 μm, or about 18 μm to about 25 μm (e.g., about 19 μm to about 21 μm). The PCD table 102 defines the working upper surface 112, at least one side surface 114, and an optional peripherally-extending chamfer 113 that extends between the at least one side surface 114 and the working upper surface 112.

A metallic interstitial constituent is disposed in at least a portion of the interstitial regions of the PCD table 102. In an embodiment, the metallic interstitial constituent includes and/or is formed from an alloy that is chosen to exhibit a selected melting temperature or melting temperature range and/or bulk modulus that are sufficiently low so that it does not break diamond-to-diamond bonds between bonded diamond grains during heating experienced during use, such as cutting operations. For example, the alloy may exhibit a bulk modulus that is less than that of a Group VIII metal in substantially pure form. During cutting operations using the PCD table 102, the relatively deformable metallic interstitial constituent may potentially extrude out of the PCD table 102. However, before, during, and after the cutting operations, the PCD table 102 still includes the metallic interstitial constituent distributed substantially entirely throughout the PCD table 102.

According to various embodiments, the alloy includes at least one Group VIII metal including cobalt, iron, nickel, or alloys thereof and at least one alloying element (e.g., a metallic alloying element) selected from silver, gold, aluminum, antimony, boron, carbon, cerium, chromium, copper, dysprosium, erbium, iron, gallium, germanium, gadolinium, hafnium, holmium, indium, lanthanum, magnesium, manganese, molybdenum, niobium, neodymium, nickel, phosphorus, praseodymium, platinum, ruthenium, sulfur, antimony, scandium, selenium, silicon, samarium, tin, tantalum, terbium, tellurium, thorium, titanium, vanadium, tungsten, yttrium, zinc, zirconium, any combination thereof, or other constituents. The at least one alloying element or combination of alloying elements may be present with the at least one Group VIII metal in an amount of about greater than 0 to about 40 atomic %, about 5 atomic % to about 35 atomic %, about 15 atomic % to about 35 atomic %, about 20 atomic % to about 35 atomic %, about 5 atomic % to about 15 atomic %, or about 30 atomic % to about 35 atomic % of the alloy. For example, a more specific group for the at least one alloying element includes boron, copper, gallium, germanium, gadolinium, phosphorous, silicon, tin, zinc, zirconium, and combinations thereof. The at least one alloying element may be alloyed with the at least one Group VIII metal in an amount at a eutectic composition, hypo-eutectic composition, or hyper-eutectic composition for the at least one Group VIII-alloying element chemical system if the at least one Group VIII-alloying element has a eutectic composition. In some embodiments, the at least one alloying element may lower a melting temperature of the at least one Group VIII metal, a bulk modulus of the at least one Group VIII metal, a coefficient of thermal expansion of the at least one Group VIII metal, or any combination thereof.

The at least one Group VIII metal may be infiltrated from the cementing constituent of the substrate 104 (e.g., cobalt from a cobalt-cemented tungsten carbide substrate) and alloyed with the at least one alloying element provided from a source other than the substrate 104. For example, the at least one alloying element may be alloyed with the at least one Group VIII metal and mixed with the diamond particles, the at least one alloying element (e.g., in powder or granule form) may be mixed with diamond particles prior to HPHT processing, the at least one alloying element may be diffused into the at least one Group VIII metal after the at least one Group VIII metal has infiltrated between the diamond particles to form the diamond grains, or combinations thereof. In such an embodiment, a depletion region of the at least one Group VIII metal in the substrate 104 in which the concentration of the at least one Group VIII metal is less than the concentration prior to being bonded to the PCD table 102 may be present at and near the interfacial surface 106. In such an embodiment, the at least one Group VIII metal may form and/or carry tungsten and/or tungsten carbide with it during infiltration into the diamond particles being sintered that, ultimately, forms the PCD table 102.

Depending on the alloy system, in some embodiments, the alloy disposed interstitially in the PCD table 102 includes: one or more solid solution alloy phases of the at least one Group VIII metal and the at least one alloying element; one or more intermediate compound phases (e.g., one or more intermetallic compounds) between the at least one alloying element and the at least one Group VIII metal and/or other metal (e.g., tungsten); one or more binary or higher-order intermediate compound phases; one or more carbide phases between the at least one alloying element, carbon, and optionally other metal(s); the at least one alloying element in elemental form, carbon, and optionally other metals; or combinations thereof. In some embodiments, when the one or more intermediate compounds are present in the alloy, the one or more intermediate compounds are present in an amount less than about 40 weight % of the alloy, such as less than about 30 weight % less, less than about 20 weight %, less than about 15 weight %, less than about 10 weight %, about 5 weight % to about 35 weight %, about 10 weight % to about 30 weight %, about 15 weight % to about 25 weight %, about 5 weight % to about 10 weight %, about 1 weight % to about 4 weight %, or about 1 weight % to about 3 weight %, with the balance being the one or more solid solution phases and/or one or more carbide phases. In other embodiments, when the one or more intermediate compounds are present in the alloy, the one or more intermediate compounds are present in the alloy in an amount greater than about 80 weight % of the alloy, such as greater than about 90 weight %, about 90 weight % to about 100 weight %, about 90 weight % to about 95 weight %, about 90 weight % to about 97 weight %, about 92 weight % to about 95 weight %, about 97 weight % to about 99 weight %, or about 100 weight % (i.e., substantially all of the alloy). That is, in some embodiments, the alloy may be a multi-phase alloy that may include one or more solid solution alloy phases, one or more intermediate compound phases, one or more carbide phases, one or more elemental constituent (e.g., an elemental alloying element, elemental carbon, or an elemental group VIII metal) phases, or combinations thereof. The inventors currently believe that the presence of the one or more intermediate compounds may enhance the thermal stability of the PCD table 102 due to the relatively lower coefficient of thermal expansion of the one or more intermediate compounds compared to a pure Group VIII metal, such as cobalt. Additionally, in some embodiments, the inventors currently believe that the presence of the solid solution alloy of the at least one Group VIII metal may enhance the thermal stability of the PCD table 102 due to lowering of the melting temperature and/or bulk modulus of the at least one Group VIII metal. In some embodiments, the presence of the solid solution alloy of the at least one Group VIII metal and alloying element may decrease or eliminate the tendency of the at least one Group VIII metal therein to cause back-conversion of carbon atoms of the diamond grains in the PCD table 102 to graphite at high temperatures, such as those experienced under drilling conditions by a PDC cutter.

For example, when the at least one Group VIII element is cobalt and the at least one alloying element is boron, the alloy may include WC phase, $Co_AW_BB_C$ (e.g., $Co_{21}W_2B_6$) phase, $Co_DB_E$ (e.g., $Co_2B$ or $BCo_2$) phase, and Co phase (e.g., substantially pure cobalt or a cobalt solid solution phase) in various amounts. According to one or more embodiments, the WC phase may be present in the alloy in an amount less than 1 weight %, or less than 3 weight %; the $Co_AW_BB_C$ (e.g., $Co_{21}W_2B_6$) phase may be present in the alloy in an amount less than 1 weight %, about 2 weight % to about 5 weight %, more than 10 weight %, about 5 weight % to about 10 weight %, or more than 15 weight %, the $Co_DB_E$ (e.g., $Co_2B$ or $BCo_2$) phase may be present in the alloy in an amount greater than about 1 weight %, greater than about 2 weight %, or about 2 weight % to about 5 weight %; and the Co phase (e.g., substantially pure cobalt or a cobalt solid solution phase) may be present in the alloy in an amount less than 1 weight %, or less than 3 weight %. Any combination of the recited concentrations for the foregoing phases may be present in the alloy. In some embodiments, the maximum concentration of the $Co_{21}W_2B_6$ may occur at an intermediate depth below the working upper surface 112 of the PCD table 102, such as about 0.010 inches to about 0.040 inches, about 0.020 inches to about 0.040 inches, or about 0.028 inches to about 0.035 inches (e.g., about 0.030 inches) below the working upper surface 112 of the PCD table. In the region of the PCD table 102 that has the maximum concentration of the $Co_{21}W_2B_6$ phase, the diamond content of the PCD table may be less than 90 weight %, such as about 80 weight % to about 85 weight %, or about 81 weight % to about 84 weight % (e.g., about 83 weight %).

In an embodiment, when the at least one alloying element is phosphorous, the at least one Group VIII element is cobalt, and the substrate 104 is a cobalt-cemented tungsten carbide substrate, the alloy may include a WC phase, a $Co_2P$ cobalt-phosphorous intermetallic compound phase, a Co phase (e.g., substantially pure cobalt or a cobalt solid solution phase), and optionally elemental phosphorous in various amounts or no elemental phosphorous. In such an embodiment, the phosphorous may be present with the cobalt in an amount of about 30 atomic % to about 34 atomic % of the alloy and, more specifically, about 33.33 atomic % of the alloy. According to one or more embodiments, the WC phase may be present in the alloy in an amount less than 1 weight %, or less than 3 weight %; the $Co_2P$ cobalt-phosphorous intermetallic compound phase may be present in the alloy in an amount greater than 80 weight %, about 80 weight % to about 95 weight %, more than 90 weight %, about 85 weight % to about 95 weight %, or about 95 weight % to about 99 weight %; and the Co phase (e.g., substantially pure cobalt or a cobalt solid solution phase) may be present in the alloy in an amount less than 1 weight %, or less than 3 weight %. Any combination of the recited concentrations (or other concentrations disclosed herein) for the foregoing phases may be present in the alloy.

Table I below lists various different embodiments for the at least one alloying element of the alloy of the metallic interstitial constituent. For some of the at least one alloying elements, the eutectic composition with cobalt and the corresponding eutectic temperature at 1 atmosphere is also listed. As previously noted, in such alloys, in some embodiments, the at least one alloying element may be present at a eutectic composition, hypo-eutectic composition, or hyper-eutectic composition for the cobalt-alloying element chemical system.

TABLE I

| Alloying Element | Melting Point (° C.) | Eutectic Composition (Atomic %) | Eutectic Temperature (° C.) |
|---|---|---|---|
| Silver (Ag) | 960.8 | N/A | N/A |
| Aluminum (Al) | 660 | N/A | N/A |
| Gold (Au) | 1063 | N/A | N/A |
| Boron (B) | 2030 | 18.5 | 1100 |
| Bismuth (Bi) | 271.3 | N/A | N/A |
| Carbon (C) | 3727 | 11.6 | 1320 |
| Cerium (Ce) | 795 | 76 | 424 |
| Chromium (Cr) | 1875 | 44 | 1395 |
| Copper (Cu) | 1085 | N/A | N/A |
| Dysprosium (Dy) | 1409 | 60 | 745 |
| Erbium (Er) | 1497 | 60 | 795 |
| Iron (Fe) | 1536 | N/A | N/A |
| Gallium (Ga) | 29.8 | 80 | 855 |
| Germanium (Ge) | 937.4 | 75 | 817 |
| Gadolinium (Gd) | 1312 | 63 | 645 |
| Hafnium (Hf) | 2222 | 76 | 1212 |
| Holmium (Ho) | 1461 | 67 | 770 |
| Indium (In) | 156.2 | 23 | 1286 |
| Lanthanum (La) | 920 | 69 | 500 |
| Magnesium (Mg) | 650 | 98 | 635 |
| Manganese (Mn) | 1245 | 36 | 1160 |
| Molybdenum (Mo) | 2610 | 26 | 1335 |
| Niobium (Nb) | 2468 | 86.1 | 1237 |
| Neodymium (Nd) | 1024 | 64 | 566 |
| Nickel (Ni) | 1453 | N/A | N/A |
| Phosphorus (P) | 44.1 (white), 610 (black), 621 (red) | 19.9 | 1023 |
| Praseodymium (Pr) | 935 | 66 | 560 |
| Platinum (Pt) | 1769 | N/A | N/A |
| Ruthenium (Ru) | 2500 | N/A | N/A |
| Sulfur (S) | 119 | 41 | 822 |
| Antimony (Sb) | 630.5 | 97 | 621 |
| Scandium (Sc) | 1539 | 71.5 | 770 |
| Selenium (Se) | 217 | 44.5 | 910 |
| Silicon (Si) | 1410 | 23 | 1195 |
| Samarium (Sm) | 1072 | 64 | 575 |
| Tin (Sn) | 231.9 | N/A | N/A |
| Tantalum (Ta) | 2996 | 13.5 | 1276 |
| Terbium (Tb) | 1356 | 62.5 | 690 |
| Tellurium (Te) | 449.5 | 48 | 980 |
| Thorium (Th) | 1750 | 38 | 960 |
| Titanium (Ti) | 1668 | 76.8 | 1020 |
| Vanadium (V) | 1900 | N/A | N/A |
| Tungsten (W) | 3410 | N/A | N/A |
| Yttrium (Y) | 1409 | 63 | 738 |
| Zinc (Zn) | 419.5 | N/A | N/A |
| Zirconium (Zr) | 1852 | 78.5 | 980 |

In a more specific embodiment, the alloy includes cobalt for the at least one Group VIII metal and zinc for the at least one alloying element. For example, the alloy of cobalt and zinc may include a cobalt solid solution phase of cobalt and zinc and/or a cobalt-zinc intermetallic phase. In another embodiment, the alloy includes cobalt for the at least one Group VIII metal and zirconium for the at least one alloying element. In a further embodiment, the alloy includes cobalt for the at least one Group VIII metal and copper for the at least one alloying element. In some embodiments, the at least one alloying element is a carbide former, such as aluminum, niobium, silicon, tantalum, or titanium. In some embodiments, the at least one alloying element may be a non-carbon metallic alloying element, such as any of the metals listed in the table above. In other embodiments, the at least one alloying element may not be a carbide former or may not be a strong carbide former compared to tungsten.

For example, copper and zinc are examples of the at least one alloying element that are not strong carbide formers. For example, in another embodiment, the alloy includes cobalt for the at least one Group VIII metal and boron for the at least one alloying element. In such an embodiment, the metallic interstitial constituent may include a number of different intermediate compounds, such as BCo, $W_2B_5$, $B_2CoW_2$, $Co_2B$, WC, $Co_{21}W_2B_6$, $Co_3W_3C$, $CoB_2$, $CoW_2B_2$, CoWB, combinations thereof, along with some pure cobalt. It should be noted that despite the presence of boron in the alloy, the alloy may be substantially free of boron carbide in some embodiments but include tungsten carbide with the tungsten provided from the substrate 104 during the sweep through of the at least one Group VIII metal into the PCD table 102 during formation thereof.

In an embodiment, nickel is the at least one Group VIII metal and phosphorous is the at least one alloying element. In such an embodiment, a metallic interstitial constituent comprising a nickel-phosphorous alloy may include on or more of $Ni_3P$, $NiP_2$, or elemental phosphorus in one or more regions of the PCD table. The eutectic amount of phosphorus alloyed with nickel in $Ni_3P$ is 19 atomic % and the eutectic amount of phosphorus in $NiP_2$ is about 47 atomic %. The eutectic temperatures of $Ni_3P$ and $NiP_2$ are about 891° C. and about 860° C., respectively.

In an embodiment, iron is the at least one Group VIII metal and phosphorous is the at least one alloying element. In such an embodiment, a metallic interstitial constituent comprising an iron-phosphorous alloy may include on or more of Fe—$Fe_3P$, $Fe_3P$—$Fe_2P$, $Fe_2P$—FeP, or elemental iron in one or more regions of the PCD table. The eutectic amount of phosphorus alloyed with iron in Fe—$Fe_3P$ is 17 atomic %, the eutectic amount of phosphorus alloyed with iron in $Fe_3P$—$Fe_2P$ is 24 atomic %, and the eutectic amount of phosphorus in $Fe_2P$—FeP is about 40 atomic %. The eutectic temperatures of Fe—$Fe_3P$, $Fe_3P$—$Fe_2P$, and $Fe_2P$—FeP are about 1048° C., about 1166° C., and about 1262° C., respectively.

Depending on the HPHT processing technique used to form the PDC 100, the alloy disposed in the interstitial regions of the PCD table 102 may exhibit a composition and/or concentration that is substantially uniform throughout the PCD table 102. This may occur when the at least one alloying element is provided by mixing the at least one alloying element in powder or granular form with diamond particles prior to HPHT processing. In other embodiments, the composition and/or concentration of the alloy disposed in the interstitial regions of the PCD table 102 may be non-uniform and exhibit a gradient (e.g., a substantially continuous gradient) in which the concentration of the at least one alloying element decreases with distance away from the working upper surface 112 of the PCD table 102 toward the substrate 104. This may occur when the at least one alloying element is provided by placing a powder, disc, film, etc. including the at least one alloying element therein adjacent to one or more outside surfaces (e.g., corresponding to the at least a portion of a side surface 114 and/or upper surface 112) of the mass of diamond particles prior to HPHT processing. In such an embodiment, if present at all, the alloy may exhibit a decreasing concentration of any intermediate compounds with distance away from the working upper surface 112 and/or side surface 114 of the PCD table 102.

The depth to which the at least one alloying element is present in the PCD table 102 may depend upon one or more of the following: the temperature of the HPHT process, the pressure of the HPHT process, the type of the at least one alloying element used in the HPHT process, the technique used to introduce the at least one alloying element to the PCD table 102, or the amount of the at least one alloying element used in the manufacture of the PCD table 102 (e.g., thickness of the layer or concentration of the at least one alloying element). For example, the depth to which the at least one alloying element is present in the alloy of the PCD table 102 as measured from the upper surface 112 or at least one side surface 114 may be at least 20 μm, at least about 250 μm, about 400 μm to about 700 μm, or about 600 μm to about 800 μm. Any of the embodiments of a first region described herein may exhibit one or more of any of the infiltration depths described herein.

Figure 1C:
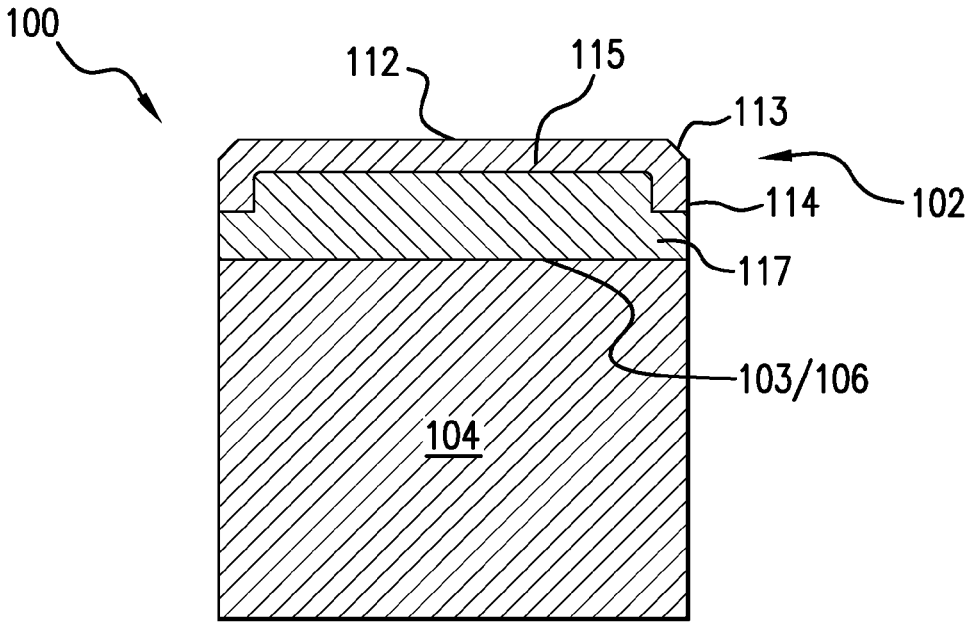
FIG. 1C is a cross-sectional view of a PDC having at least one alloying element diffused into the PCD table according to an embodiment.

In some embodiments, when the at least one alloying element is capable of diffusing into the PCD table 102 and alloying with at least one Group VIII metal, the inventors currently believe that the depth of diffusion of the at least one alloying element should be sufficient so that the alloy forms at a depth of at least about 250 μm as measured from the upper surface 112 and/or side surface 114. Such diffusion may improve thermal stability, catalytic stability, wear resistance, or combinations thereof relative to a PCD table that does not contain appreciable amounts of the at least one alloying element. Referring to FIG. 1C, in such an embodiment in which the at least one alloying element is diffused into the PCD table from an outside surface thereof, two distinct regions of the PCD table 102 may be formed: a first region 115 extending inwardly from the upper surface 112 and generally contouring the chamfer 113. In an embodiment, the alloy may consist essentially of at least one intermediate compound of the at least one alloying element and the at least one Group VIII metal in the interstitial regions and a second region 117 adjacent to the substrate 104, with the second region 117 being substantially free of the at least one intermediate compound in which the interstitial regions thereof include cobalt in elemental and/or solid solution form. Optionally, the at least one alloying element and/or the elemental form of the at least one alloying element may be present in the second region 117.

In an embodiment, when the at least one alloying element is phosphorus and at least one Group VIII metal is cobalt, the inventors currently believe that a depth of phosphorous diffusion (e.g., a presence of $Co_2P$) of at least about 250 μm as measured from the upper surface 112 improves thermal stability and/or wear resistance relative to a PCD table that does not contain appreciable amounts of phosphorous. Referring again to FIG. 1C, in such an embodiment in which the phosphorous is diffused into the PCD table from an outside surface thereof, the first region 115 may extend inwardly from the upper surface 112 and generally contour the chamfer 113. In such a configuration, the alloy may consist essentially of $Co_2P$ in the interstitial regions and the second region 117 may be substantially free of $Co_2P$ in which the interstitial regions thereof include cobalt in elemental and/or solid solution form. Optionally, phosphorous and/or elemental phosphorous may be present in the second region 117. In an embodiment in which the at least one Group VIII metal is iron, the alloy of the first region 115 may consist essentially of $Fe_3P$ and/or $Fe_2P$ in the interstitial regions and the second region 117 adjacent to the substrate 104, with the second region 117 being substantially free of $Fe_3P$ and/or $Fe_2P$. Optionally, the interstitial regions of the second region 117 may include iron in elemental and/or solid solution form and may include phosphorous in solid solution form and/or elemental phosphorous in the interstitial regions. In an embodiment in which the at least one Group VIII metal is nickel, the alloy of the first region 115 may consist essentially of $Ni_3P$ and/or $Ni_5P_2$ in the interstitial regions and the second region 117 adjacent to the substrate 104, with the second region 117 being substantially free of $Ni_3P$ and/or $Ni_5P_2$. Optionally, the interstitial regions of the second region 117 may include nickel in elemental and/or solid solution form and may include phosphorous and/or elemental phosphorous in solid solution form the interstitial regions.

Figure 1D:
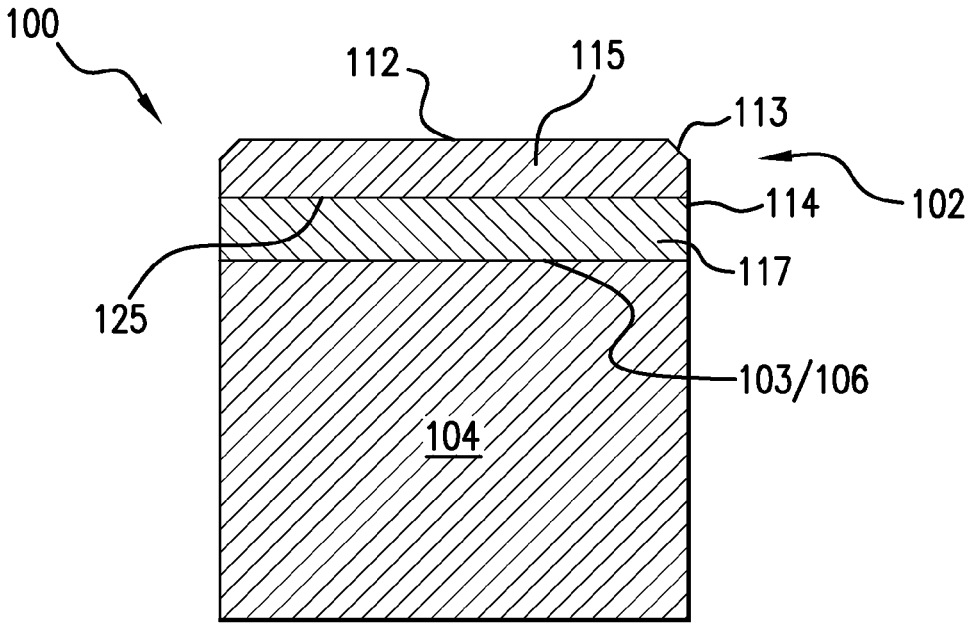
FIG. 1D is a cross-sectional view of a PDC having at least one alloying element diffused into the PCD table according to an embodiment.

FIG. 1D illustrates another embodiment in which the first region 115 exhibits a different configuration than that shown in FIG. 1C. The geometry of the first region 115 may define a substantially horizontal boundary 125 between the first region 115 and the underlying second region 117. In the illustrated embodiment, the substantially horizontal boundary 125 is located below the chamfer 113. However, in other embodiments, the substantially horizontal boundary 125 may be located substantially at the bottom of the chamfer 113. While the substantially horizontal boundary 125 is substantially planar, in some embodiments, the boundary between the first region and the underlying second region 117 may be substantially non-planar (e.g., domed, zigzagged, stepped, dimpled, arcuate, undulating, sinusoidal, combinations thereof, or any other non-planar configuration).

It should be noted that when the at least one alloying element is mixed with the diamond particles used to form the PCD table (either in a powder form and/or pre-alloyed with the Group VIII metal in powder form), the alloy may be substantially homogenous and the concentration of the at least one alloying element may be substantially uniform throughout the PCD table 102. For example, in an embodiment when phosphorus is the at least one alloying element, the alloy may include almost entirely $Co_2P$ when the at least one Group VIII metal is cobalt, the alloy may include almost entirely $Fe_3P$ and/or $Fe_2P$ when the at least one Group VIII metal is iron, or the alloy may include almost entirely $Ni_3P$ and/or $Ni_5P_2$ when the at least one Group VIII metal is nickel.

The alloy of the PCD table 102 may be selected from a number of different alloys exhibiting a melting temperature of about 1400° C. or less and/or a bulk modulus at 20° C. of about 150 GPa or less. As used herein, melting temperature refers to the lowest temperature at which melting of a material begins at standard pressure conditions (i.e., 100 kPa). For example, depending upon the composition of the alloy, the alloy may melt over a temperature range such as occurs when the alloy has a hypereutectic composition or a hypoeutectic composition where melting begins at the solidus temperature and is substantially complete at the liquidus temperature. In other cases, the alloy may have a single melting temperature as occurs in a substantially pure metal or a eutectic alloy.

In one or more embodiments, the alloy exhibits a coefficient of thermal expansion of about $3\times10^{-6}$ per ° C. to about $20\times10^{-6}$ per ° C., a melting temperature of about 180° C. to about 1300° C., and a bulk modulus at 20° C. of about 30 GPa to about 150 GPa; a coefficient of thermal expansion of about $15\times10^{-6}$ per ° C. to about $20\times10^{-6}$ per ° C., a melting temperature of about 180° C. to about 1100° C., and a bulk modulus at 20° C. of about 50 GPa to about 130 GPa; a coefficient of thermal expansion of about $15\times10^{-6}$ per ° C. to about $20\times10^{-6}$ per ° C., a melting temperature of about 950° C. to about 1100° C. (e.g., 1090° C.), and a bulk modulus at 20° C. of about 120 GPa to about 140 GPa (e.g., about 130 GPa); or a coefficient of thermal expansion of about $15\times10^{-6}$ per ° C. to about $20\times10^{-6}$ per ° C., a melting temperature of about 180° C. to about 300° C. (e.g., about 250° C.), and a bulk modulus at 20° C. of about 45 GPa to about 55 GPa (e.g., about 50 GPa). For example, the alloy may exhibit a melting temperature of less than about 1200° C. (e.g., less than about 1100° C.) and a bulk modulus at 20° C. of less than about 140 GPa (e.g., less than about 130 GPa). For example, the alloy may exhibit a melting temperature of less than about 1200° C. (e.g., less than 1100° C.), and a bulk modulus at 20° C. of less than about 130 GPa.

When the HPHT sintering pressure is greater than about 7.5 GPa cell pressure, optionally in combination with the average diamond grain size being less than about 30 μm, any portion of the PCD table 102 (prior to being leached) defined collectively by the bonded diamond grains and the alloy may exhibit a coercivity of about 115 Oe or more and the alloy content in the PCD table 102 may be less than about 7.5% by weight as indicated by a specific magnetic saturation of about 15 $G\cdot cm^3/g$ or less. In another embodiment, the coercivity may be about 115 Oe to about 250 Oe and the specific magnetic saturation of the PCD table 102 (prior to being leached) may be greater than 0 $G\cdot cm^3/g$ to about 15 $G\cdot cm^3/g$. In another embodiment, the coercivity may be about 115 Oe to about 175 Oe and the specific magnetic saturation of the PCD may be about 5 $G\cdot cm^3/g$ to about 15 $G\cdot cm^3/g$. In yet another embodiment, the coercivity of the PCD table (prior to being leached) may be about 155 Oe to about 175 Oe and the specific magnetic saturation of the first region 115 may be about 10 $G\cdot cm^3/g$ to about 15 $G\cdot cm^3/g$. The specific permeability (i.e., the ratio of specific magnetic saturation to coercivity) of the PCD table 102 may be about 0.10 $G\cdot cm^3/g\cdot Oe$ or less, such as about 0.060 $G\cdot cm^3/g\cdot Oe$ to about 0.090 $G\cdot cm^3/g\cdot Oe$. In some embodiments, the average grain size of the bonded diamond grains may be less than about 30 μm and the alloy content in the PCD table 102 (prior to being leached) may be less than about 7.5% by weight (e.g., about 1% to about 6% by weight, about 3% to about 6% by weight, or about 1% to about 3% by weight). Additionally, details about magnetic properties that the PCD table 102 may exhibit are disclosed in U.S. Pat. No. 7,866,418, the disclosure of which is incorporated herein, in its entirety, by this reference.

In some embodiments in which the at least one Group VIII metal is cobalt and the PCD table 102 is unleached, the PDC 100 may exhibit a thermal stability characterized by a distance that it may cut in a mill test (as described in more detail below) prior to failure of at least about 155 inches, such as 155 inches to about 300 inches, 160 inches to about 170 inches, about 170 inches to about 220 inches, about 190 inches to about 240 inches, about 220 inches to about 260 inches, or about 250 inches to about 290 inches. The thermal stability of a PDC may be evaluated in a mill test in which the PDC is used to cut a Barre granite workpiece without any coolant (i.e., dry cutting of the Barre granite workpiece in air). The test parameters used for the mill test may be a back rake angle for the PDC of about 20°, an in-feed for the PDC of about 50.8 cm/min, a width of cut for the PDC of about 7.62 cm (i.e., two PDC cutters mounted to a fly cutter assembly), a depth of cut for the PDC of about 0.762 mm, a rotary speed on the workpiece of about 3000 RPM, an indexing across the workpiece (e.g., in the Y direction) of about 7.62 cm, about 20 seconds between cutting passes, and the size of the Bane granite workpiece may be approximately 30.48 cm wide by 30.48 cm high by 73.66 cm long. The PDC may be held in a cutting tool holder, with the substrate of the PDC tested thermally insulated on its back side via an alumina disc and along its circumference by a plurality of zirconia pins. Failure is considered when the PDC can no longer cut the workpiece.

Figure 2:
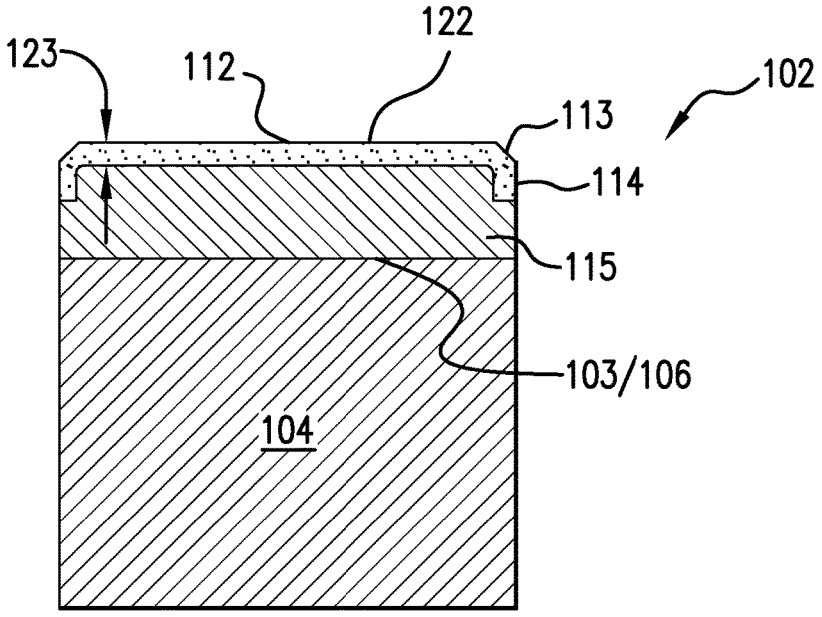
FIG. 2 is a cross-sectional view of another embodiment in which the PCD table shown in FIGS. 1A and 1B is leached to deplete the metallic interstitial constituent from a leached region thereof.

Referring specifically to the cross-sectional view of FIG. 2, in an embodiment, the PCD table 102 may be leached to improve the thermal stability and/or wear resistance thereof. The PCD table 102 includes a region 115 adjacent to the interfacial surface 106 of the substrate 104. The region 115 of the PCD table 102 includes a metallic interstitial constituent that occupies at least a portion of the interstitial regions thereof. For example, the metallic interstitial constituent may include any of the alloys disclosed herein. It should also be noted that another region (not shown) may be disposed between the region 115 and the substrate 104, which may include at least one Group VIII metal and be substantially free of the at least one alloying element that is present in the region 115 in the alloy thereof. The PCD table 102 also includes a leached region 122 remote from the substrate 104 that includes the upper surface 112, the chamfer 113, and a portion of the at least one side surface 114. The leached region 122 extends inwardly to a selected depth or depths from the upper surface 112, the chamfer 113, and a portion of the at least one side surface 114.

The leached region 122 has been leached to deplete the metallic interstitial constituent therefrom that previously occupied the interstitial regions between the bonded diamond grains of the leached region 122. The leaching may be performed in a suitable acid (e.g., aqua regia, nitric acid, hydrofluoric acid, or combinations thereof) so that the leached region 122 is substantially free of the metallic interstitial constituent. As a result of the metallic interstitial constituent (e.g., a Group VIII metal-alloying metal alloy such as a cobalt-phosphorus alloy) being depleted from the leached region 122, the leached region 122 may be relatively more thermally stable than the underlying region 115.

Generally, a selected leach depth 123 may be greater than 250 μm. For example, the selected leach depth 123 for the leached second region 122 may be about 300 μm to about 425 μm, about 250 μm to about 400 μm, about 350 μm to about 400 μm, about 350 μm to about 375 μm, about 375 μm to about 400 μm, or about 500 μm to about 650 μm. The selected leach depth 123 may be measured inwardly from at least one of the upper surface 112, the chamfer 113, or the at least one side surface 114. Any of the embodiments of PDCs described herein may include a leached region extending any of the leach depths described above. Any of the leached regions described herein may include at least a portion of any of the first regions described herein. For example, any of the embodiments described with respect to FIGS. 1C and 1D may include a leached region 122 as described with respect to FIG. 2.

Figure 3A:
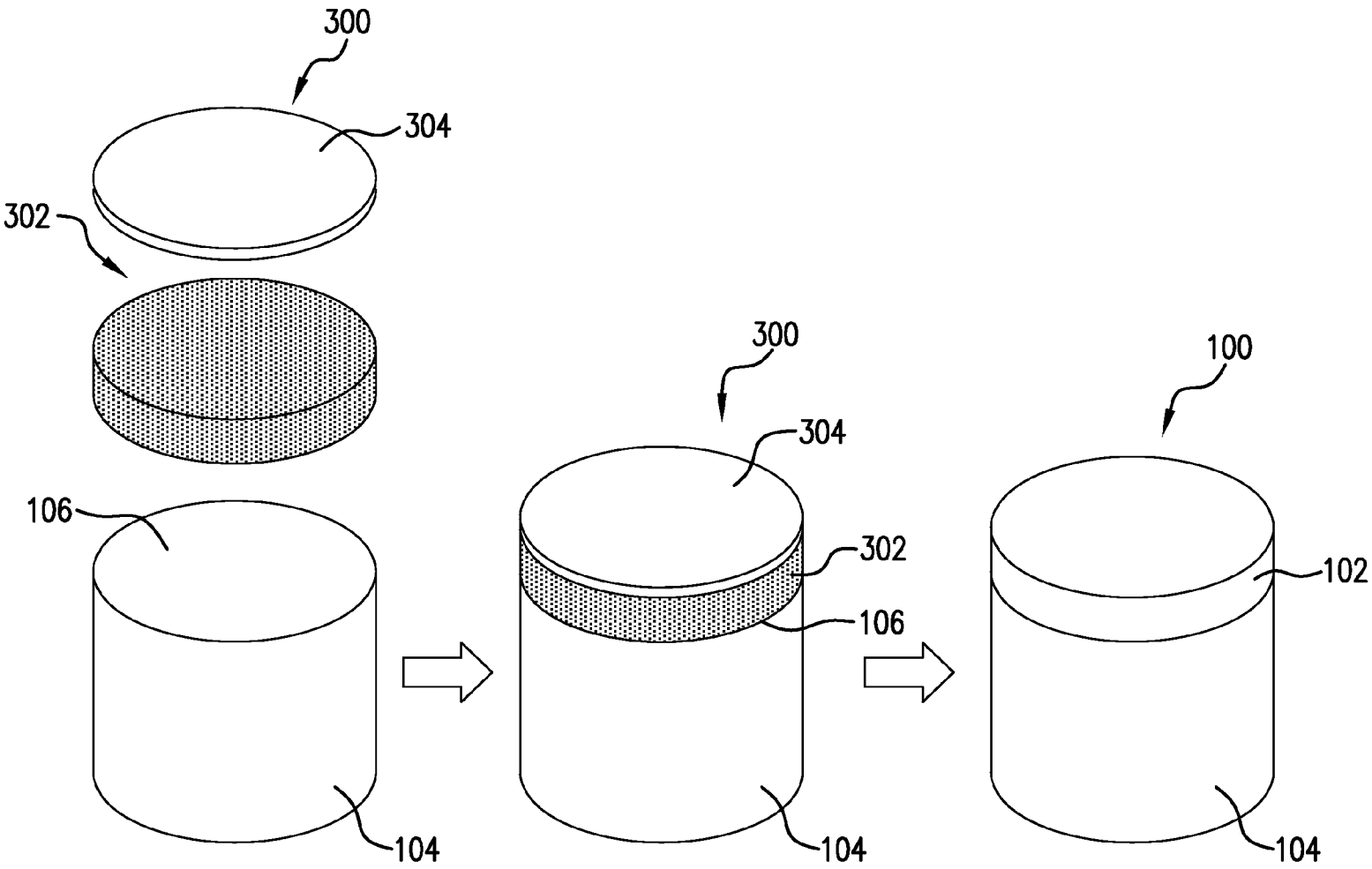
FIG. 3A is a schematic diagram at different stages during the fabrication of the PDC shown in FIGS. 1A and 1B according to an embodiment of a method.

FIG. 3A is a schematic diagram at different stages during the fabrication of the PDC 100 shown in FIGS. 1A and 1B according to an embodiment of a method. Referring to FIG. 3A, an assembly 300 including a mass of diamond particles 302 is positioned between the interfacial surface 106 of the substrate 104 and at least one material 304 that includes any of the alloying elements disclosed herein (e.g., at least one alloying element that lowers a temperature at which melting of at least one Group VIII metal begins and exhibits a melting temperature greater than that of the melting temperature of the at least one Group VIII metal). For example, the at least one material 304 may be in the form of particles of the alloying element(s), a thin disc of the alloying element(s), a green body of particles of the alloying elements(s), at least one material of the alloying element(s), or combinations thereof. In some embodiments, the at least one alloying element may even comprise carbon in the form of at least one of graphite, graphene, fullerenes, or other $sp^2$-carbon-containing particles. In an embodiment, the at least one material 304 may include phosphorus such as in the form of particles of phosphorous, a thin disc of phosphorous, a green body of particles of phosphorous, an alloy of the Group VIII metal and phosphorous in disc or powder form, or combinations thereof. A suitable size range for the phosphorous particles may include particles of about 5 nm or more, such as about 10 nm to about 500 μm, about 50 nm to about 200 μm, about 100 nm to about 50 μm, about 200 nm to about 20 μm, or about 500 mm or less. The phosphorous may be in any form of phosphorous, such as white phosphorus, red phosphorous, violet phosphorous, black phosphorous, or combinations thereof. Any of the types of phosphorous forms may be in amorphous or crystalline form. As previously discussed, the substrate 104 may include a metal-solvent catalyst as a cementing constituent comprising at least one Group VIII metal, such as cobalt, iron, nickel, or alloys thereof. For example, the substrate 104 may comprise a cobalt-cemented tungsten carbide substrate in which cobalt is the at least one Group VIII metal that serves as the cementing constituent.

The diamond particles may exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). In various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of diamond particles may include a portion exhibiting a relatively larger size between about 40 μm and about 15 μm and another portion exhibiting a relatively smaller size between about 12 μm and 2 μm. Of course, the diamond particles may also include three or more different sizes (e.g., one relatively larger size and two or more relatively smaller sizes), without limitation.

The assembly 300 may be placed in a pressure transmitting medium, such as a refractory metal can embedded in pyrophyllite or other pressure transmitting medium, and subjected to a first stage HPHT process. For example, the first stage HPHT process may be performed using an ultra-high pressure press to create temperature and pressure conditions at which diamond is stable. The temperature of the first stage HPHT process may be at least about 1000° C. (e.g., about 1200° C. to about 1600° C.) and the pressure of the HPHT process may be at least 4.0 GPa (e.g., about 5.0 GPa to about 12 GPa or about 7.5 GPa to about 11 GPa) for a time sufficient to sinter the diamond particles to form a PCD table. For example, the pressure of the first stage HPHT process may be about 7.5 GPa to about 10 GPa and the temperature of the HPHT process may be about 1150° C. to about 1450° C. (e.g., about 1200° C. to about 1400° C.). The foregoing pressure values employed in the HPHT process refer to the cell pressure in the pressure transmitting medium that transfers the pressure from the ultra-high pressure press to the assembly.

In an embodiment, during the first stage HPHT process, the at least one Group VIII metal from the substrate 104 or another source (e.g., metal-solvent catalyst mixed with the diamond particles) liquefies and infiltrates into the mass of diamond particles 302 and sinters the diamond particles together to form a PCD table having diamond grains exhibiting diamond-to-diamond bonding (e.g., $sp^3$ bonding) therebetween with the at least one Group VIII metal disposed in the interstitial regions between the diamond grains. In an embodiment, the at least one alloying element from the at least one material 304 does not melt during the first stage HPHT process (e.g., sintering conditions) and/or is enclosed within a protective enclosure or behind a protective partition made from a material that does not melt during the first stage HPHT process regardless of the melting temperature of the at least one material 304. Thus, in such an embodiment, the at least one alloying element and/or protective partition or enclosure has a melting temperature or range thereof greater than the at least one Group VIII metal (e.g., cobalt) that is used. Suitable materials for the protective partition or enclosure include, but are not limited to, silicon, iridium, zirconium, molybdenum, tungsten, tungsten carbide, niobium, tantalum, titanium, another refractory material, or alloys of one or more of the foregoing. In an embodiment, if the substrate 104 is a cobalt-cemented tungsten carbide substrate, cobalt from the substrate 104 may be liquefied and infiltrate the mass of diamond particles 302 to catalyze formation of the PCD table, and the cobalt may subsequently be cooled to below its melting point or range. Then, the temperature of a second stage heating process (e.g., alloying conditions) may be increased (e.g., about 1850° C. to about 1900° C.) to diffuse the at least one alloying element into the at least one Group VIII metal (e.g., while the at least one Group VIII metal is liquefied). In an embodiment, the protective partition or enclosure may be melted or at least softened to promote diffusion of the at least one alloying element therein (e.g., boron, phosphorous, silicon, etc.) into the at least one Group VIII metal.

In an embodiment where the at least one alloying element includes phosphorus, at atmospheric pressure, white phosphorous melts at around 44.2° C., violet phosphorous melts at around 589.5° C., black phosphorous melts at around 610° C., and red phosphorous melts at around 621° C. Red phosphorous is amorphous, and black phosphorous may be formed by heating white or red phosphorous at high pressure. Amorphous red phosphorous tends to remain amorphous after exposure to about 5.2 GPa. The inventors currently believe that red phosphorous changes to orthorhombic crystal structure after HPHT processing, which is the typical crystal structure for black phosphorous. The inventors also currently believe that amorphous red phosphorous changes to orthorhombic black phosphorous before reaction with cobalt to form $Co_2P$. Therefore, it may be desirable to use a protective partition or enclosure to promote diffusion of an alloying element having a melting point below that of the Group VIII metal, such as phosphorus, into the at least one Group VIII metal in the sintered polycrystalline diamond mass.

After sintering the diamond particles to form the PCD table in the first stage HPHT process, in a second stage heating process (e.g., a second stage HPHT process or other heating process), the temperature is increased from ambient or from the temperature employed in the first stage HPHT process (e.g., sintering conditions), while still maintaining application of the same, less, or higher cell pressure to maintain diamond-stable conditions. The temperature of the second stage heating process (e.g., alloying conditions) may be chosen to partially or completely diffuse and/or melt the at least one alloying element and/or protective enclosure of the at least one material 304 into the at least one Group VIII metal, which then alloys with at least some of the at least one Group VIII metal interstitially disposed in the PCD table and forms the final PCD table 102 having the alloy disposed interstitially between at least some of the diamond grains. Optionally, the temperature of the second stage heating process may be controlled so that the at least one Group VIII metal is still liquid or partially liquid so that the alloying with the at least one alloying element occurs in the liquid phase, which may speed diffusion of the at least one alloying element into the at least one Group VIII metal. However, in some embodiments, diffusion may occur via solid state and/or liquid diffusion, without limitation.

In an embodiment, after the first stage HPHT process, the pressure transmitting medium, (e.g., refractory metal can embedded in pyrophyllite or other pressure transmitting medium) may be removed from around the sintered PCD table and/or PDC including such a sintered PCD table. Subsequently, the sintered PCD table and/or PDC may be reloaded into another pressure transmitting medium having the at least one alloying element therein or may be sealed in a container configured to prevent oxidizing conditions from reaching the at least one alloying element (e.g., phosphorus) therein. In an embodiment, after removing the pressure transmitting medium from around the sintered PCD table and/or PDC, the sintered PCD and/or PDC may be placed in contact with the at least one alloying element in and may be heated according to the second stage heating process. In such an embodiment, an inert environment may be provided, while heating (e.g., a partial vacuum environment, argon gas, or $N_2$ gas) to avoid oxidizing the at least one alloying element.

Before or after alloying, the PDC may be subjected to finishing processing to, for example, chamfer the PCD table, form a desired outer diameter or other lateral dimension (e.g., centerless grinding, form a desired geometry (e.g., wave pattern, zig-zag pattern, or any single feature in the upper surface, planarize the upper surface thereof, or combinations thereof. The temperature of the second stage heating process may be about 1500° C. to about 1900° C., and the temperature of the first stage HPHT process may be about 1350° C. to about 1450° C. After and/or during cooling from the second stage heating process, the PCD table 102 bonds to the substrate 104. As discussed above, the alloying of the at least one Group VIII metal with the at least one alloying element may lower a melting temperature of the at least one Group VIII metal and and/or may lower at least one of a bulk modulus or coefficient of thermal expansion of the at least one Group VIII metal.

For example, in an embodiment, the at least one material 304 may comprise boron particles, such as boron particles mixed with aluminum oxide particles. In another embodiment, the at least one material 304 may comprise copper or a copper alloy in powder or foil form. In such embodiments, the pressure of the second stage heating process may be about 5.5 GPa to about 6.5 GPa cell pressure and the temperature of the second stage heating process may be about 1550° C. to about 1650° C. (e.g., 1600° C.), which is maintained for about 1 minutes to about 35 minutes (e.g., about 2 minutes to about 35 minutes, about 2 minutes to about 5 minutes, about 10 to about 15 minutes, about 5 to about 10 minutes, or about 25 to about 35 minutes).

In an embodiment, a second stage heating process may not be needed. Particularly, alloying may be possible in a single HPHT process. In an example, when the at least one alloying element is copper or a copper alloy, the copper or copper alloy may not always infiltrate the un-sintered diamond particles under certain conditions. For example, after the at least one Group VIII metal has infiltrated (or as it infiltrates the diamond powder) and at least begins to sinter the diamond particles, copper may be able and/or begin to alloy with the at least one Group VIII metal. Such a process may allow materials that would not typically infiltrate diamond powder to do so during or after infiltration by a catalyst.

Alloying may be possible by merely heating (e.g., in a partial vacuum or in an inert gas environment such as argon, helium, nitrogen, carbon dioxide, any other inert gas, or combinations thereof) the at least one alloying element positioned adjacent to a previously sintered PCD table to a temperature above the melting point of the at least one alloying element and the at least one group VIII metal (which may be disposed in the sintered PCD table or in a substrate adjacent thereto. In such an embodiment, the at least one alloying element may react with the at least one Group VIII metal to at least partially alloy therewith. In an embodiment the at least one alloying element may be subjected to a temperature above the melting point of the at least one alloying element yet below the melting temperature of the at least one group VIII metal. The second stage heating process may include a pressure of about 2 GPa or less, such as about 0.0 GPa to about 2 GPa, about 0.5 GPa to about 1.5 GPa, about 1 GPa or less, about 0.5 GPa or less, at about atmospheric pressure, or under vacuum of less than about $10^{-2}$ torr, such as about $10^{-3}$ torr to about $10^{-9}$ torr, about $10^{-2}$ torr to about $10^{-5}$ torr, about $10^{-5}$ torr to about $10^{-9}$ torr, or less than about $10^{-9}$ torr. As used herein pressure includes negative pressure such as vacuum or partial vacuum pressures. For example, in an embodiment, the second stage heating process may be carried out using a pressure of about $10^{-9}$ torr to about 2 GPa, such as about $10^{-5}$ torr to about 1 GPa. In such an embodiment, the at least one alloying element may react with the at least one Group VIII metal to at least partially alloy therewith. For example, the PCD table may be disposed into the at least one alloying element to a depth, as measured from the upper surface, of about 0.005 inches or more, such as about 0.01 inches to about 0.1 inches, about 0.02 inches to about 0.06 inches, about 0.04 inches, or less than about 0.01 inches. In order to provide contact, the PCD table may at least partially contact a powder including the at least one alloying element, or may at least partially contact a solid body (e.g., pellet or green state part) having a selected surface configuration (e.g., matching).

Figure 3B:
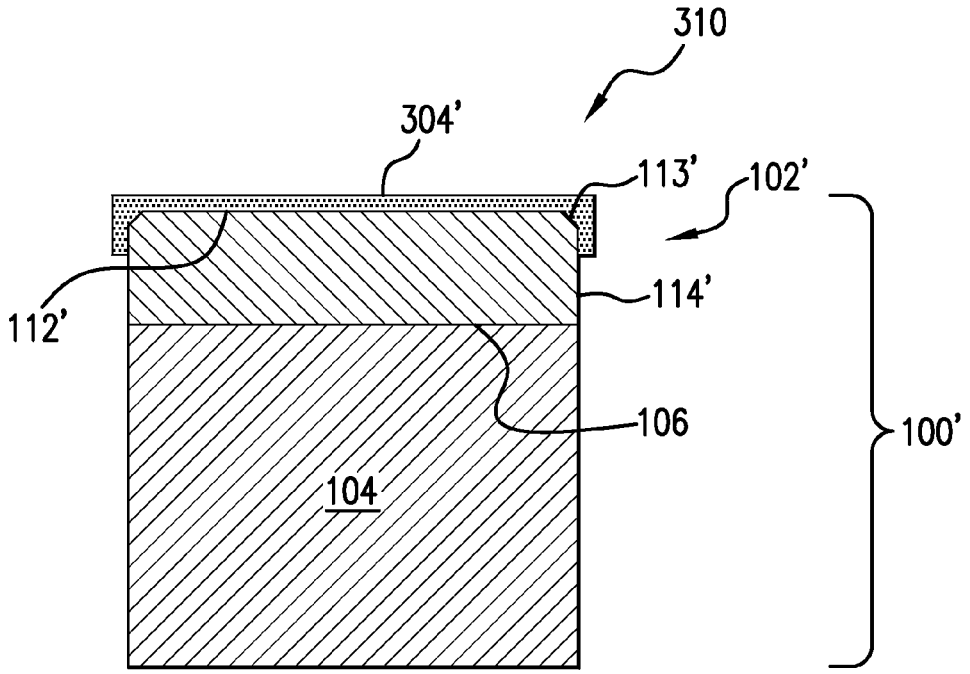
FIGS. 3B and 3C are cross-sectional views of precursor PDC assemblies during the fabrication of the PDC shown in FIGS. 1A and 1B according to another embodiment of a method.

FIG. 3B is a cross-sectional view of a precursor PDC assembly 310 during the fabrication of the PDC 100 shown in FIGS. 1A and 1B according to another embodiment of a method. In this method, a precursor PDC 100' is provided that has already been fabricated and includes a PCD table 102' integrally formed with substrate 104. For example, the precursor PDC 100' may be fabricated using the same HPHT process conditions as the first stage HPHT process discussed above. Additionally, details about fabricating a precursor PDC 100' according to known techniques is disclosed in U.S. Pat. No. 7,866,418, the disclosure of which was previously incorporated by reference. Thus, the PCD table 102' includes bonded diamond grains exhibiting diamond-to-diamond bonding (e.g., $sp^3$ bonding) therebetween, with at least one Group VIII metal (e.g., cobalt) disposed interstitially between the bonded diamond grains (either without or without the presence of at least one alloying element therein).

At least one material 304' of any of the at least one alloying elements (or mixtures or combinations thereof) disclosed herein may be positioned adjacent to an outer surface of the PCD table 102', such as adjacent to one or more of the upper surface 112', side surface 114', or chamfer 113' of the PCD table 102' to form the precursor PDC assembly 310. For example, the at least one material 304' may be positioned on at least 50% of a surface area of the upper surface 112', all of the surface area of the chamfer 113', and/or at least part of the surface area (e.g., more or less than 50%) of the side surface 114'. For example, the at least one material 304' may be in the form of particles of the alloying element(s), a thin disc of the alloying element(s), a green body of particles of the alloying element(s), an alloy of at least one Group VIII metal and the at least alloying element (e.g., a Co—P alloy) in any of the preceding forms, or combinations thereof. Although the PCD table 102' is illustrated as being chamfered with a chamfer 113' extending between the upper surface 112' and at least one side surface 114', in some embodiments, the PCD table 102' may not have a chamfer. As the PCD table 102' is already formed, any of the at least one alloying elements disclosed herein may be used, regardless of its melting temperature. The precursor PDC assembly 310 may be subjected to an HPHT process using the same or similar HPHT conditions as the second stage heating process discussed above or even lower temperatures for certain low-melting at least one alloying elements, such as bismuth. For example, the temperature may be about 800° C. or less, such as about 400° C. to about 800° C., about 200° C. to about 500° C., about 100° C. to about 400° C., about 500° C. to about 800° C., or about 600° C. to about 700° C., about 600° C., or about 650° C., for such embodiments. During the second stage heating process, the at least one alloying element partially or completely melts and/or diffuses to alloy with the at least one Group VIII metal of the PCD table 102' which may or may not be liquid or partially liquid depending on the temperature and pressure. The at least one alloying element may alloy with the at least one Group VIII metal substantially through the entire PDC table or to a depth therein as measured from the outer surface of the PCD table (e.g., having a uniform concentration or a concentration that varies).

In some embodiments, the pressure employed in the second stage heating process may be below that of the first stage HPHT process or pressure typically used in HPHT processes which is typically above about 2 GPa. In some embodiments, such second stage heating may take place without additional pressure applied to the assembly, such as only at ambient pressure or under vacuum, so long as the elevated temperature is sufficient to melt the at least one alloying element. In an embodiment, when the at least one material 304" includes phosphorus, the PCD table 102' may be infiltrated by heating the phosphorus to about 44.1° C. or more (e.g., about 610° C. depending on the form of phosphorus). Such second stage heating may take place in a vacuum furnace or other non-reactive conditions (e.g., Ar or $N_2$ gas atmosphere), which may prevent oxidation (e.g., ignition or burning) of the phosphorus at elevated temperatures. The duration of the second stage heating can be 10 minutes or more, such as about 5 minutes to 24 hours, about 1 hour to about 18 hours, about 2 hours to about 12 hours, about 3 hours to about 9 hours, about 6 hours, about 6 hours to about 18 hours, about 12 hours, or less than about 24 hours. In some embodiments, the furnace temperature may be returned to a lower temperature (e.g., ambient) prior to exposing the PCDs to the ambient environment, such that oxidation reactions therewith are limited.

In an embodiment, the pressure and/or temperature of the second stage heating process may be chosen at least partially based on the specific alloying element used in order to promote diffusion and/or alloying of the at least one alloying element into the PCD table 102' to a selected depth measured from the upper surface 112', such as at least 250 μm, at least about 250 μm, about 400 μm to about 700 μm, about 600 μm to about 800 μm, or greater than 1000 μm. For example, in an embodiment, the at least one material 304' may comprise boron or phosphorous particles. In another embodiment, the at least one material 304' may comprise copper or a copper alloy in powder or foil form. In such embodiments, the pressure of the second stage heating process may be about 5.5 GPa to about 6.5 GPa cell pressure and the temperature of the second stage heating process may be about 1550° C. to about 1650° C. (e.g., 1600° C.), which is maintained for about 2 minutes to about 35 minutes (e.g., about 10 to about 15 minutes, about 5 to about 10 minutes, or about 25 to about 35 minutes).

In an embodiment, the at least one material 304' may include phosphorus in any form (e.g., powder, foil, or disc form). In such an embodiment, the pressure of the second stage heating process may be about 5.2 GPa to about 6.5 GPa and the temperature of the second stage heating process may be about 1380° C. to about 1900° C., and the temperature of the first stage HPHT process may be about 1350° C. to about 1450° C. For example, in an embodiment, the pressure of the second stage heating process may be about 5.2 GPa to about 6.5 GPa (e.g., 5 GPa to about 5.5 GPa) and the temperature of the second stage heating process may be about 1000° C. to about 1500° C. (e.g., 1380° C. to about 1500, or about 1400° C.), and the pressure of the first stage HPHT process may be about 7.5 GPa to about 8.5 GPa and the temperature of the first stage HPHT process may be about 1370° C. to about 1430° C. (e.g., about 1400° C.). For example, the pressure of the second stage heating process may be lower than that of the first stage HPHT process, which may help prevent damage to the PCD table 102' during the second stage heating process. In an embodiment, no additional pressure over the first HPHT process may be used during the second heating process and the temperature may be at least about 40° C., such as about 44° C. to about 800° C., about 400° C. to about 700° C., about 100° C. to about 500° C., about 1000° C. to about 2000° C., or about 800° C. to about 1500° C.

Processing the precursor PDC assembly 310 may result in forming the PCD table 102 having the configuration shown in FIG. 1C in which the first region 115 contours the upper surface 112 and the chamfer 113.

Figure 3C:
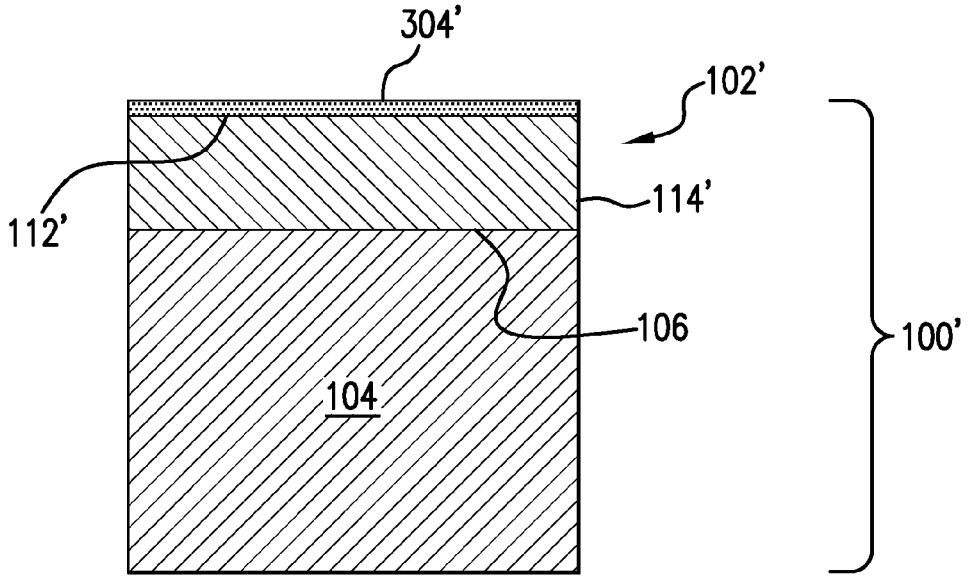

Although the PCD table 102' is illustrated in FIG. 3B as being chamfered with the chamfer 113' extending between the upper surface 112' and at least one side surface 114', in some embodiments as shown in FIG. 3C, the PCD table 102' may not have a chamfer. HPHT processing the precursor PDC assembly shown in FIG. 3C may result in forming the PCD table 102 having the configuration shown in FIG. 1D in which the first region 115 is partially defined by the general horizontal boundary 125. In such an embodiment, the PDC may be formed to exhibit an oversized outer diameter or other lateral dimension, which may be reduced by grinding (e.g., centerless grinding) or other material removal process after HPHT processing.

In some embodiments, the at least one material 304' of the at least one alloying element may be non-homogenous. For example, the at least one material 304' may include a layer of a first alloying element having a first melting temperature encased/enclosed in a layer of a second alloying element having a second melting temperature greater than the first melting temperature. For example, the first one of the at least one alloying element may be silicon or a silicon alloy and the second one of the at least one alloying element may be zirconium or a zirconium alloy. During the melting of the at least one material 304' (e.g., during the second stage heating process), once the second alloying element is completely melted and alloys the at least one Group VIII metal, the first alloying element may escape and further alloy the at least one Group VIII metal of the PCD table. In other embodiments, the first alloying element may diffuse through the layer of the second alloying element via solid state or liquid diffusion to alloy the at least one Group VIII metal.

Figure 3D:
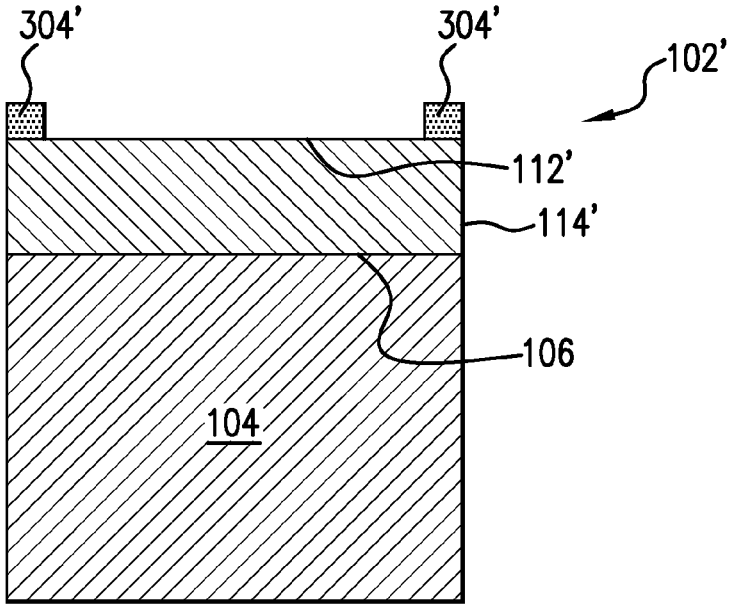
FIGS. 3D and 3E are cross-sectional views of precursor PDC assemblies during fabrication according to another embodiment of a method.
Figure 3E:
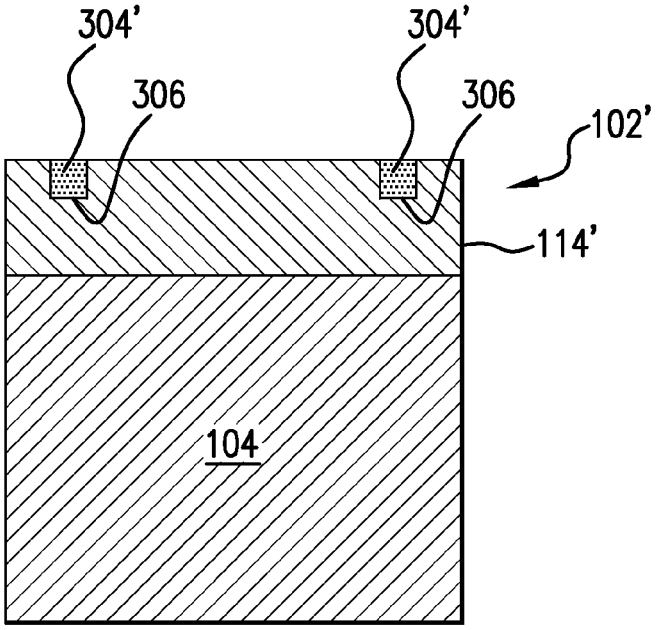
Figure 3F:
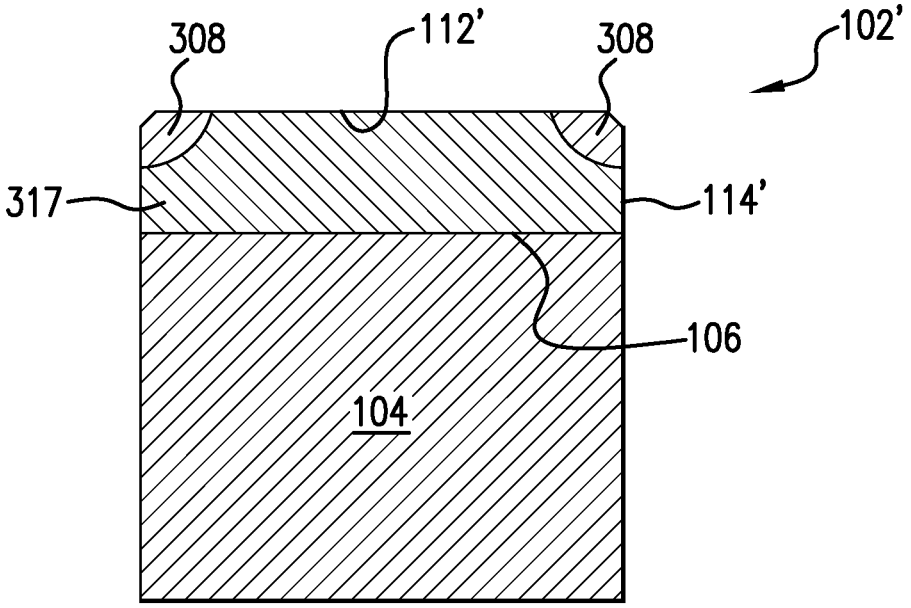
FIG. 3F is a cross-sectional view of an embodiment of a PDC after processing the precursor PDC assembly shown in FIG. 3D.

Referring to FIG. 3D, in another embodiment, the at least one material 304' may be shaped, sized, and configured so that the at least one alloying element diffuses into the at least one Group VIII metal in selected location(s) of the PCD table 102'. For example, as shown, a generally annular body of the at least one material 304' may be positioned on top of the PDC table 102' extending thereabout at or near the side surface 114' of the PCD table 102'. FIG. 3E illustrates another embodiment for diffusing the at least one alloying element into the at least one Group VIII metal in selected location(s) of the PCD table 102'. For example, one or more grooves 306 may be machined in the PCD table 102' such as by laser machining. The at least one material 304' may be positioned in the one or more grooves 306. FIG. 3F illustrates an embodiment of a resultant structure of the PCD table 102' after performing the second stage heating process on the structure shown in FIG. 3D in which the at least one alloying element of the at least one material 304' diffuses into the PCD table 102' to form a first region 308, which can extend peripherally about the PCD table 102', in which the at least one Group VIII metal thereof is alloyed with the at least one alloying element. The PCD table 102' includes a second region 317 substantially free of the at least one alloying element or having a minimal amount of alloying element therein (e.g., less than 25% of the amount of alloying element content of the first region 308). While the first region 308 is shown FIG. 3F as a peripheral region, many different configurations for the first region 308 are contemplated and discussed below. In some embodiments, the first region 308 may be similar or identical to the first region 115 described above.

Figure 3G:
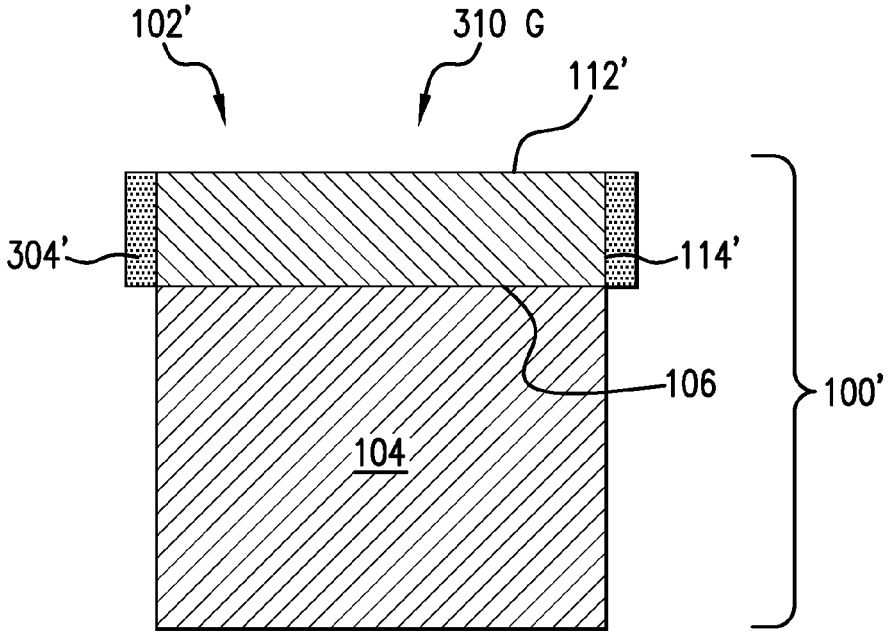
FIG. 3G is a cross-sectional view of an embodiment of a precursor assembly.
Figure 3H:
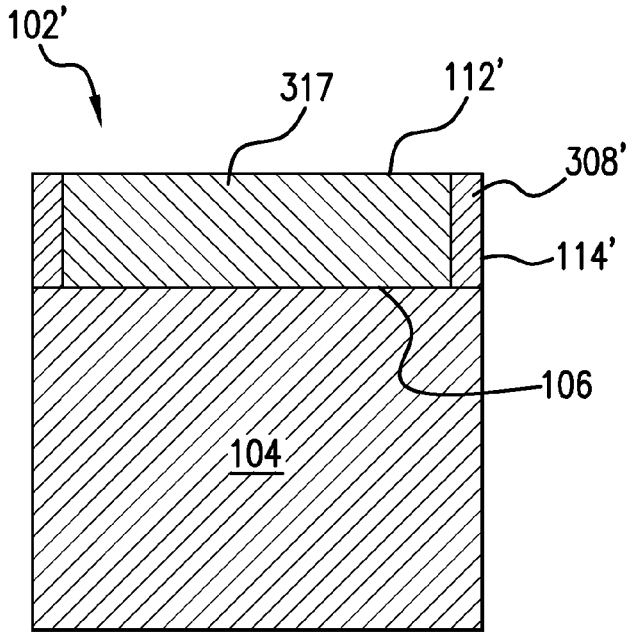
FIG. 3H is a cross-sectional view of an embodiment of a PDC after processing the precursor PDC assembly shown in FIG. 3G.

Referring to FIG. 3G, in an embodiment of a cell assembly 310*g*, the at least one material 304' may be in the form of a generally annular body positioned about at least a portion of the side surface 114' of the PCD table 102'. In such an embodiment, the at least one alloying element of the at least one material 304' diffuses into interstitial regions adjacent to the side surface 114' of the PCD table 102' under second stage heating conditions. For example, as shown, the generally annular body of the at least one material 304' may be positioned about at least a portion of the side surface 114' of the PDC table 102' and extending at least a portion of the height of the side surface 114' (e.g., substantially the entire thickness, 70% to 90% of the length of the side surface 114, or more or less than about half the thickness of the PCD table 102'). FIG. 3H illustrates the resultant structure of the PCD table 102' after performing the second stage heating process on the structure shown in FIG. 3G in which the at least one alloying element of the at least one material 304' diffuses into the PCD table 102' to form a first region 308' extending peripherally about at least as portion of the side surface 114' in which the at least one Group VIII metal thereof is alloyed with the at least one alloying element. As shown, the at least one alloying element may diffuse into the PCD table 102' to form a region (e.g., the peripheral or first region 308') substantially parallel to the one or more surfaces that the at least one material 304' is disposed on or adjacent to (e.g., the upper surface 112' or the side surface 114'). In the illustrated embodiment, the first region 308' is shown without any standoff from the substrate 104. However, in other embodiments, the first region 308' may be spaced from the substrate 104 a selected standoff distance. The PCD table 102' may include a second region 317 substantially free of alloying element or containing less than 25 weight % of the at least one alloying element content of the first region 308' therein. In an embodiment, when the layer, disc, foil, powder or other form of the at least one material 304' positioned on or about at least a portion of the PCD table 102' has a substantially uniform thickness, the resulting first region 308' may exhibit a substantially uniform thickness.

Figure 3I:
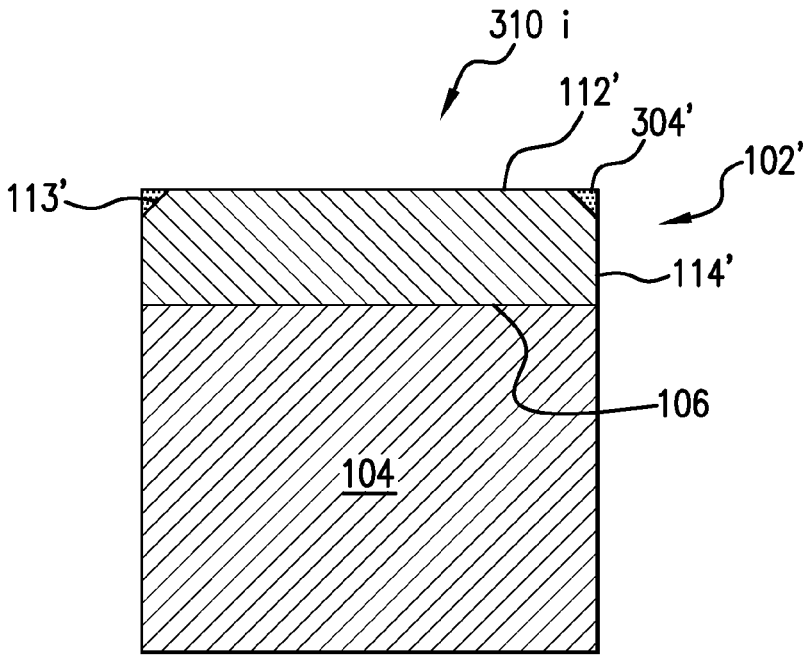
FIG. 3I is a cross-sectional view of an embodiment of a precursor assembly.
Figure 3J:
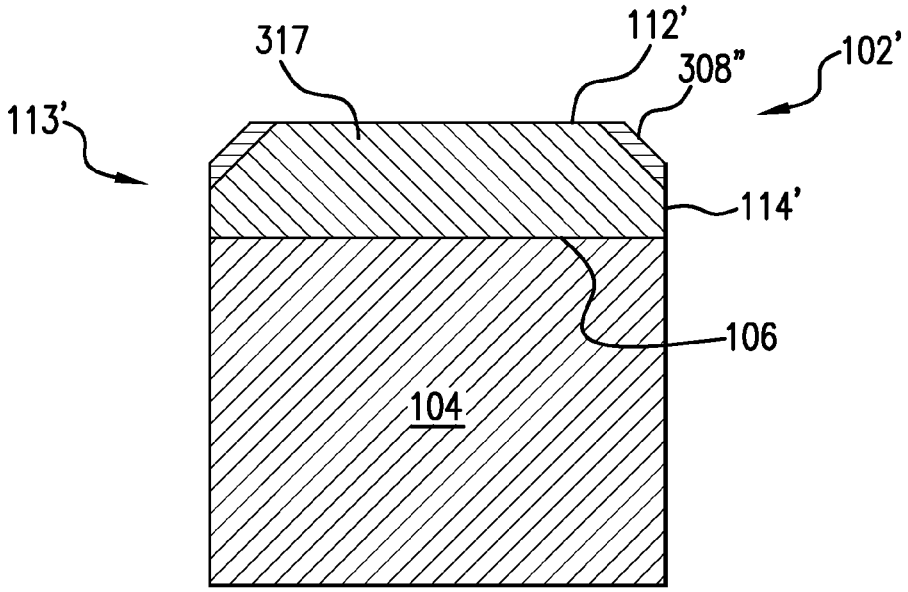
FIG. 3J is a cross-sectional view of an embodiment of a PDC after processing the precursor PDC assembly shown in FIG. 3I.

Referring to FIG. 3I, in an embodiment of a cell assembly 310*i*, the PCD table 102' may include a chamfer 113' and the at least one material 304' may be in the form of a generally annular body extending thereabout so that the at least one alloying element diffuses into the at least one Group VIII metal in selected location(s) of the PCD table 102' adjacent to the chamfer 113'. For example, as shown, the generally annular body of the at least one material 304' may be positioned about at least a portion of the chamfer 113' of the PDC table 102'. FIG. 3J illustrates one embodiment of a resultant structure of the PCD table 102' after performing the second stage heating process on the structure shown in FIG. 3I in which the at least one alloying element of the at least one material 304' diffuses into the PCD table 102' to form the first region 308" and in which the at least one Group VIII metal thereof is alloyed with the at least one alloying element. As shown, the at least one alloying element may diffuse into the PCD table 102' to form the first region 308" extending substantially parallel to the surface of the chamfer 113' and surrounding at least a portion of a second region 317 having substantially no alloying element therein.

Figure 3K:
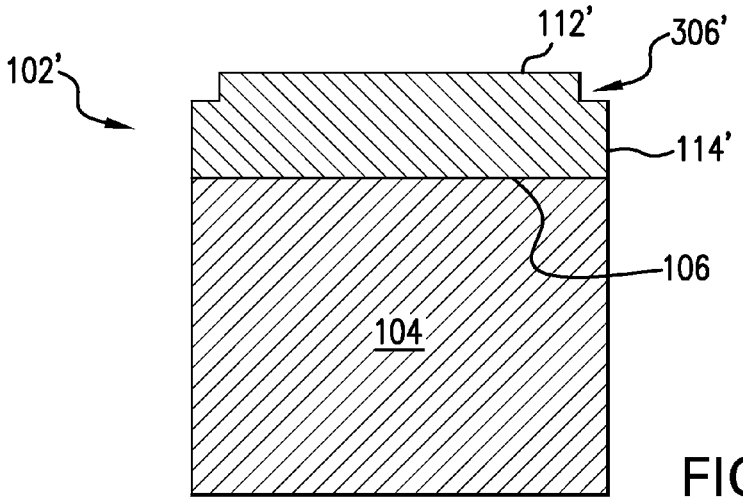
FIG. 3K is a cross-sectional view of an embodiment of a PDC that has been subjected to a finishing process.

Referring to FIG. 3K, a PCD table 102' may include one or more recesses 306' formed therein. For example, one or more recesses 306' may be machined in the PCD table 102' such as by laser machining, EDM, grinding, or lapping. For example, as shown, the recess 306' may be positioned substantially between the side surface 114' and the upper surface 112'. In an embodiment, the one or more recesses 306' may extend vertically or laterally along the side surface 114', or may extend across or about at least a portion of the upper surface 112'. The recess 306', as shown in FIG. 3K, may have a substantially rectangular cross-sectional shape. In embodiments, the cross-sectional shape of the recess 306' may be substantially rounded (e.g., semi-circular or semi-elliptical), v-shaped, non-uniform, or combinations of any of the foregoing.

Figure 3L:
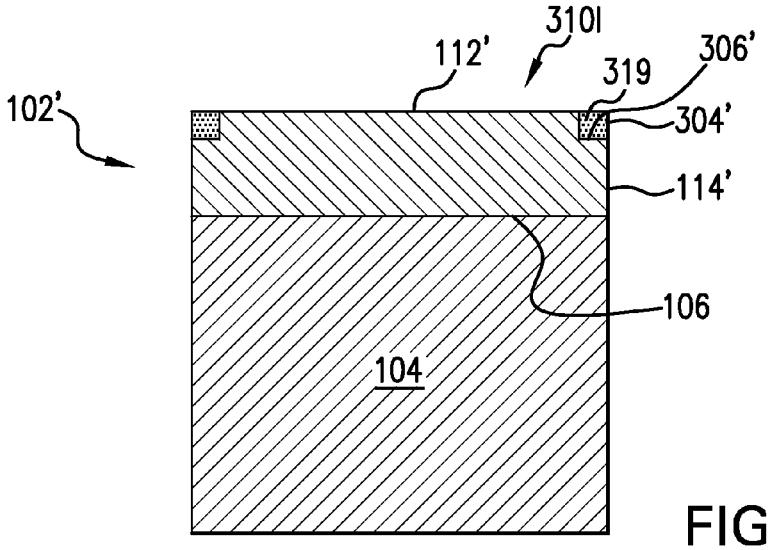
FIG. 3L is a cross-sectional view of an embodiment of a precursor assembly using the PDC of FIG. 3K.
Figure 3M:
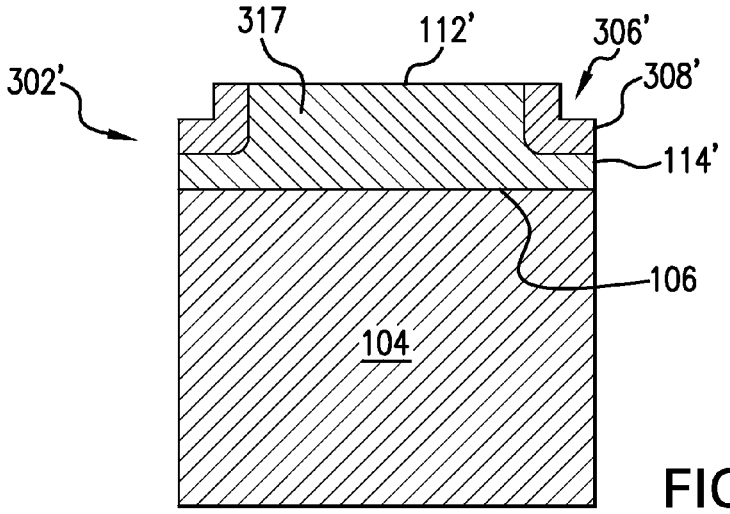
FIG. 3M is a cross-sectional view of an embodiment of a PDC after processing the precursor PDC assembly shown in FIG. 3L.

Referring to FIG. 3L in an embodiment of a cell assembly 310*l*, the at least one material 304' may be in the form of a generally annular body positioned in the groove 306' in the PCD table 102' in FIG. 3K and extending at least partially thereabout. FIG. 3M illustrates one embodiment of a resultant structure of the PCD table 102' after performing the second stage heating process on the structure shown in FIG. 3L in which the at least one alloying element of the at least one material 304' diffuses into the PCD table 102' to form the first region 308' and in which the at least one Group VIII metal thereof is alloyed with the at least one alloying element. The at least one alloying element of the at least one material 304' may diffuse into the PCD table 102' such that the first region 308' extends generally vertically along a vertical portion (e.g., neck) of the groove 306' and extending generally horizontally along a horizontal portion (e.g., shoulder) of the groove 306'. As shown, the first region 308' may extend substantially parallel to one or more surfaces of the groove 306', thereby forming a ring-shaped first region 308'.

Figure 3N:
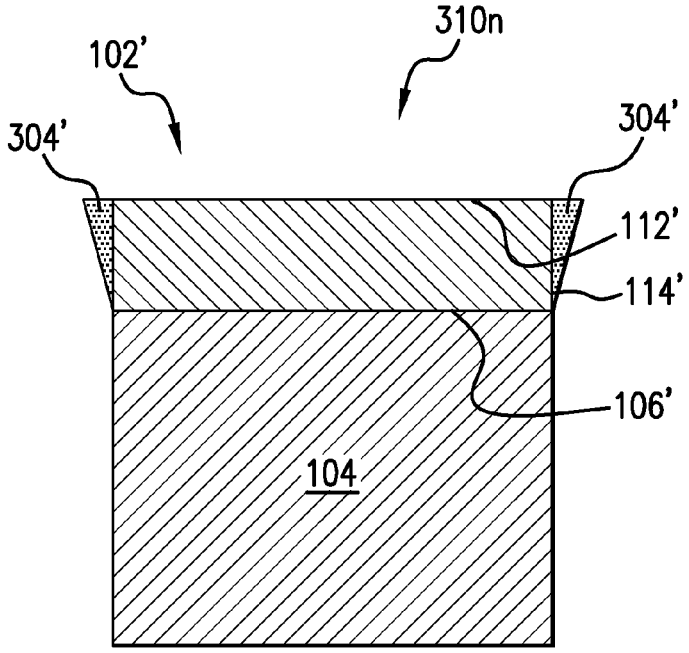
FIG. 3N is a cross-sectional view of an embodiment of a precursor assembly.
Figure 3O:
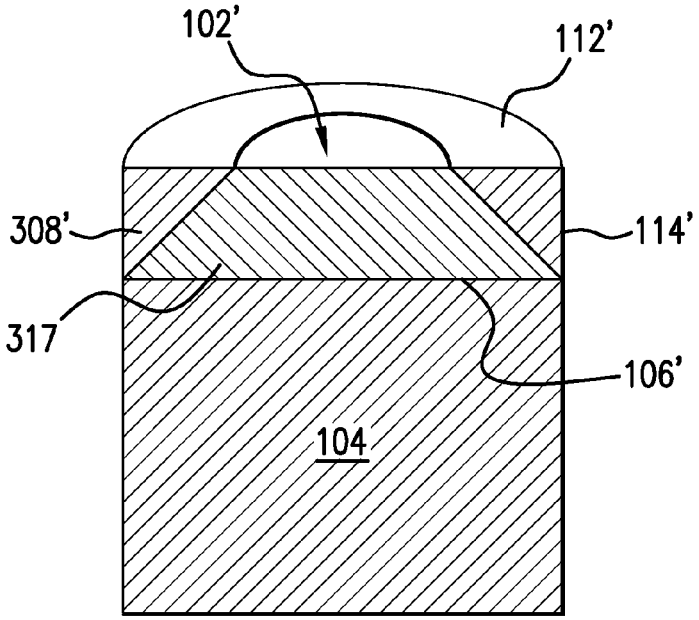
FIG. 3O is an isometric cross-sectional view of an embodiment of a PDC after processing the precursor PDC assembly shown in FIG. 3N.

In an embodiment, the at least one material 304' may be distributed in a greater amount or thickness near or adjacent to one or more portions of PCD table 102' and a lesser amount or thickness at another portion of PCD table 102'. Referring to FIG. 3N, in an embodiment of a cell assembly 310*n*, the at least one material 304' may be in the form of a generally annular or ring-shaped body extending around at least a portion of the side surface 114' of the PCD table 102'. The at least one material 304' in the generally annular or ring-shaped body may exhibit a greater thickness near the upper surface 112' of the PCD table 102' and a smaller amount of the at least one material near the interfacial surface 106'. FIG. 3O illustrates one embodiment of a resultant structure of the PCD table 102' after performing the second stage heating process on the structure shown in FIG. 3N in which the at least one alloying element of the at least one material 304' diffuses into the PCD table 102' to form the first region 308' and in which the at least one Group VIII metal thereof is alloyed with the at least one alloying element. The first region 308' in FIG. 3O formed from the assembly shown in FIG. 3N may exhibit a greater depth (with respect to the side surface 114') of diffusion of the at least one alloying element adjacent to the upper surface 112' and a lower depth of diffusion adjacent to the interfacial surface 106'. As shown, the at least one alloying element may diffuse into the PCD table 102' to form the first region 308' surrounding at least a portion of a second region 317 having a generally complementary shape to the peripheral region having substantially no alloying element therein. In some embodiments, the at least one material 304' may exhibit any number of thicknesses therein and the resulting PCD table 102' formed therefrom may exhibit any number of corresponding depths of diffusion of the at least one alloying element of the at least one material. For example, as shown in FIG. 3N, the at least one material 304' may have a gradually increasing thickness therethrough. In an embodiment, the at least one material 304' may include a stepped thickness, a domed thickness therein, or any other suitable pattern of differing thicknesses therein. Such thicknesses may include a graduating or stepping thickness of about 0 μm to about 800 μm, about 100 μm to about 500 μm, or about 250 μm to about 600 μm, or about 400 μm to about 800 μm.

Figure 3P:
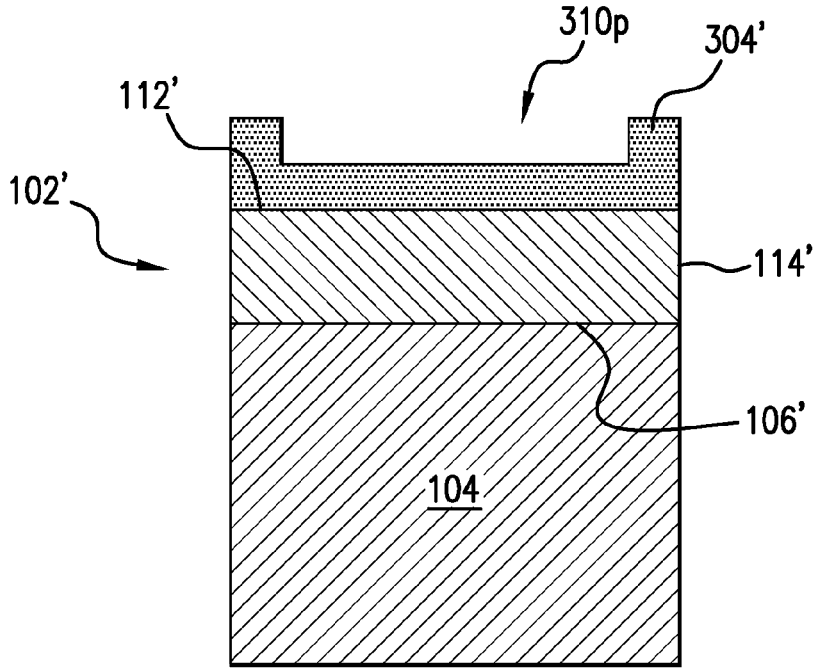
FIG. 3P is a cross-sectional view of an embodiment of a precursor assembly.
Figure 3Q:
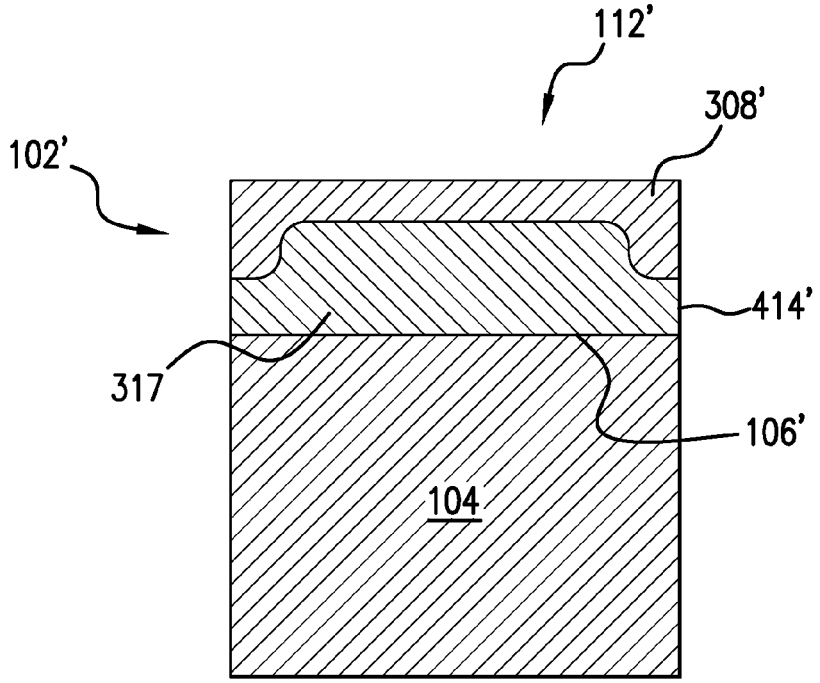
FIG. 3Q is a cross-sectional view of an embodiment of a PDC after processing the precursor PDC assembly shown in FIG. 3P.

Referring to FIG. 3P, in an embodiment of a cell assembly 310*p*, the at least one material 304' may be in the form of a generalized disc having a generally annular wall portion extending therefrom. The disc of at least one material 304' may be positioned on top of the PDC table 102' and include a generally annular wall portion thereon extending about at least a portion of the disc, with the generally annular wall portion adjacent to the side surface 114' of the PCD table 102'. Put another way, the at least one material 304' may be positioned on top of the upper surface 112' and may have a portion exhibiting a greater thickness or height above the upper surface 112' than other portions of the at least one material 304'. For example, as shown the at least one material 304' may exhibit in increased thickness in a portion thereof at or adjacent to the side surface of the PCD table 102'. FIG. 3Q illustrates one embodiment of a resultant structure of the PCD table 102' after performing the second stage heating process on the structure shown in FIG. 3P in which the at least one alloying element of the at least one material 304' diffuses into the PCD table 102' to form the first region 308' and in which the at least one Group VIII metal thereof is alloyed with the at least one alloying element. As shown, the at least one alloying element may diffuse into the PCD table 102' to form the first region 308' having a top portion extending over at least a portion of the upper surface 112' and a peripheral portion extending along at least a portion of the side surface 114' and circumferentially surrounding at least a portion of a second region 317 having substantially no alloying element therein. The first region 308' may extend deeper into the PCD table 102' from the upper surface 112' adjacent to the locations of the thicker portions of the at least one material 304'. For example, as shown in FIG. 3Q, the resulting first region 308' from the cell assembly 310*p* (FIG. 3P) exhibits a portion extending deeper into the PCD table 102' at the side surface 114' than the portion of the first region 308' adjacent to the center of the upper surface 112'.

In some embodiments, the body of at least one material 304' may be disposed on less than about 50% of the surface area of one or more of the upper surface 112' and/or side surface 114' of the PCD table 102', such as about 10% to about 50%, about 20% to about 40%, about 30% to about 50%, or about 33% of the surface area of the upper surface 112' and/or side surface 114' of the PCD table 102'. In some embodiments, the body of at least one material 304' may be disposed on 50% or more of the surface area of one or more of the upper surface 112' and/or side surface 114' of the PCD table 102', such as about 50% to about 100%, about 60% to about 90%, about 75% to about 100%, or about 80% of the surface area of the upper surface 112' and/or the side surface 114' of the PCD table 102'. The body of the at least one material 304' may have a substantially uniform or a non-uniform thickness.

Figure 3R:
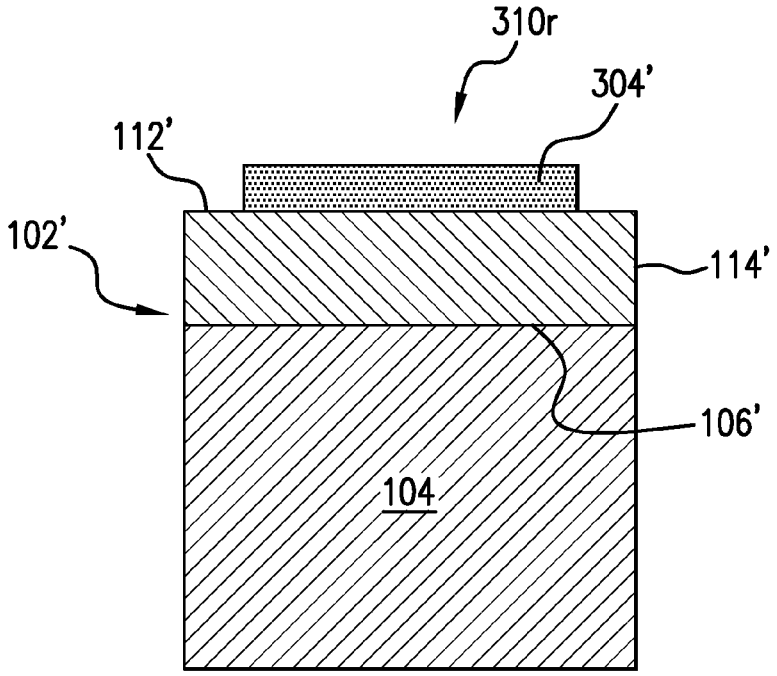
FIG. 3R is a cross-sectional view of an embodiment of a precursor assembly.
Figure 3S:
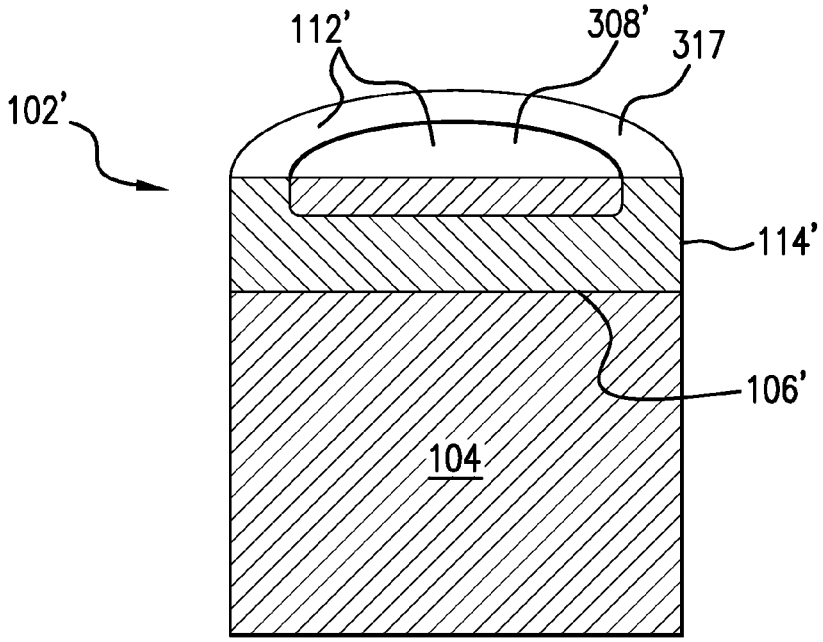
FIG. 3S is an isometric cross-sectional view of an embodiment of a PDC after processing the precursor PDC assembly shown in FIG. 3R.

Referring to FIG. 3R, in an embodiment of a cell assembly 310*r*, the at least one material 304' may be in the form of a body or mass disposed on a surface area smaller than the total surface area of the upper surface 112' so that the at least one alloying element diffuses into the at least one Group VIII metal in selected location(s) of the PCD table 102'. For example, as shown, the disk-shaped body of the at least one material 304' may be positioned on top of the PDC table 102' extending thereabout and spaced or offset inward from the side surface 114' of the PCD table 102'. FIG. 3S illustrates one embodiment of a resultant structure of the PCD table 102' after performing the second stage heating process on the structure shown in FIG. 3R in which the at least one alloying element of the at least one material 304' diffuses into the PCD table 102' to form the first region 308' and in which the at least one Group VIII metal thereof is alloyed with the at least one alloying element. As shown, the at least one alloying element may diffuse into the PCD table 102' to form the first region 308' having a substantially cylindrical geometry as shown. The first region 308' may extend inward from least a portion of the upper surface 112' and may be at least partially spaced from the side surface 114' by a peripheral portion of a second region 317 having substantially no alloying element therein. In some embodiments, the thickness of the first region, the second region, or peripheral portions of the second region may extend any suitable distance and may extend distances into the PCD table 102' substantially identical to or varying from one or more of each other.

Figure 3T:
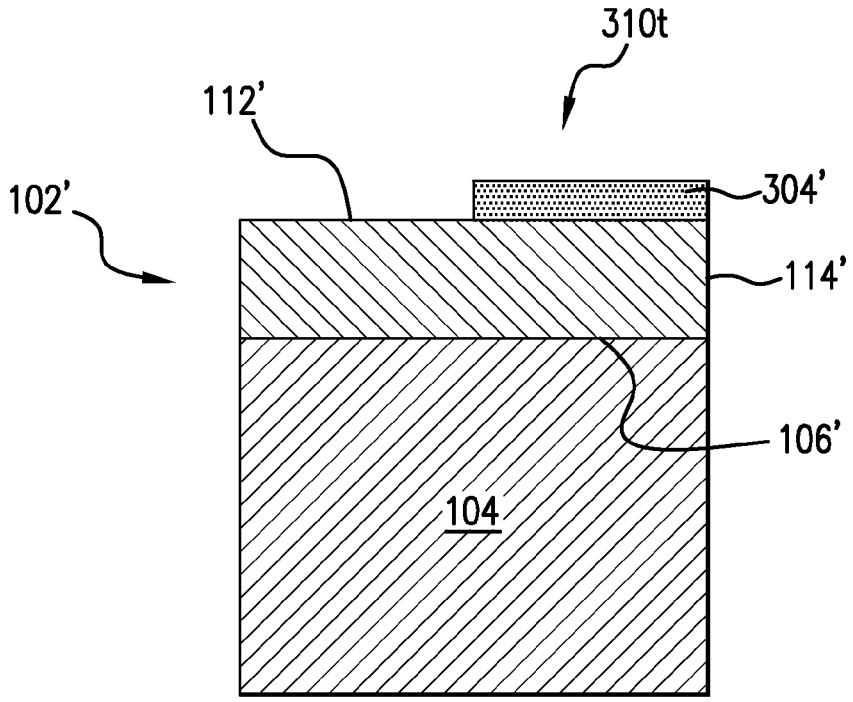
FIG. 3T is a cross-sectional view of an embodiment of a precursor assembly.
Figure 3U:
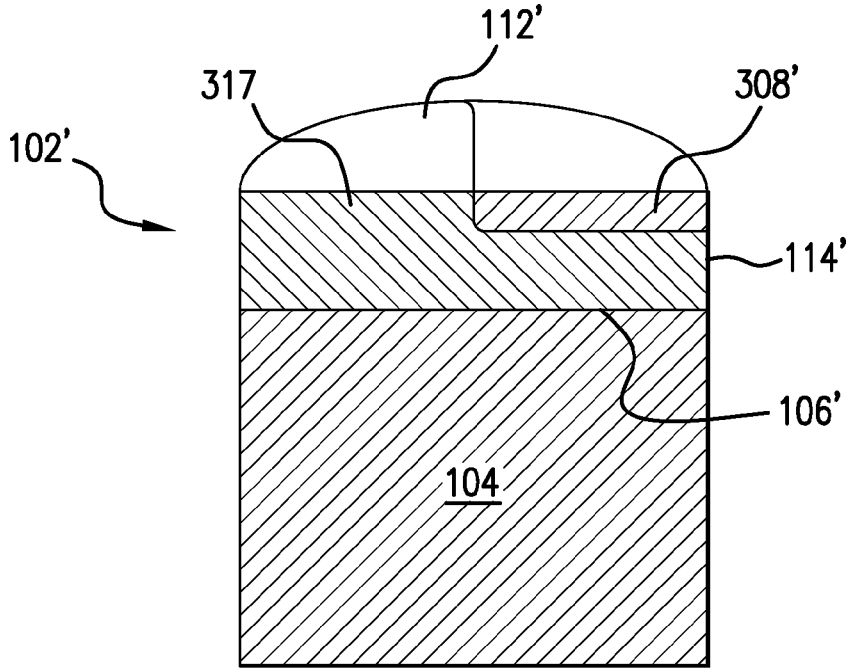
FIG. 3U is an isometric cross-sectional view of an embodiment of a PDC after processing the precursor PDC assembly shown in FIG. 3T.

In certain drilling operations, only a portion of a PDC may perform the cutting during drilling. In some embodiments, the at least one alloying element may be diffused into only the portion of the PCD table that function as a cutting region (e.g., an outer half, outer third, generally annular region, etc.). In some embodiments, the body of at least one material 304' may be disposed on 50% or less of the surface area of the upper surface 112' of the PCD table 102'. Referring to FIG. 3T, in an embodiment of a cell assembly 310*t*, the at least one material 304' may be in the form of a semi-cylindrical body so that the at least one alloying element diffuses into the at least one Group VIII metal in selected location(s) of the PCD table 102'. For example, as shown, the semi-cylindrical body of the at least one material 304' may be positioned on top of the PDC table 102' extending thereabout at or near the side surface 114' of half of the PCD table 102'. FIG. 3U illustrates an embodiment of a resultant structure of the PCD table 102' after performing the second stage heating process on the structure shown in FIG. 3T in which the at least one alloying element of the at least one material 304' diffuses into the PCD table 102' to form the first region 308' and in which the at least one Group VIII metal thereof is alloyed with the at least one alloying element. As shown, the at least one alloying element may diffuse into the PCD table 102' to form the first region 308' extending along approximately half of the upper surface 112' of the PCD table 102' and extending to a depth therein. The PCD table 102' may also include a second region 317 having substantially no alloying element therein. In some embodiments, the first region 308' may be substantially crescent shaped, half annular, rectangular, wedge shaped (e.g., third or quarter of a circle), or any other suitable configuration. The second region 317 may occupy the remaining volume of PCD table 102'.

Figure 3V:
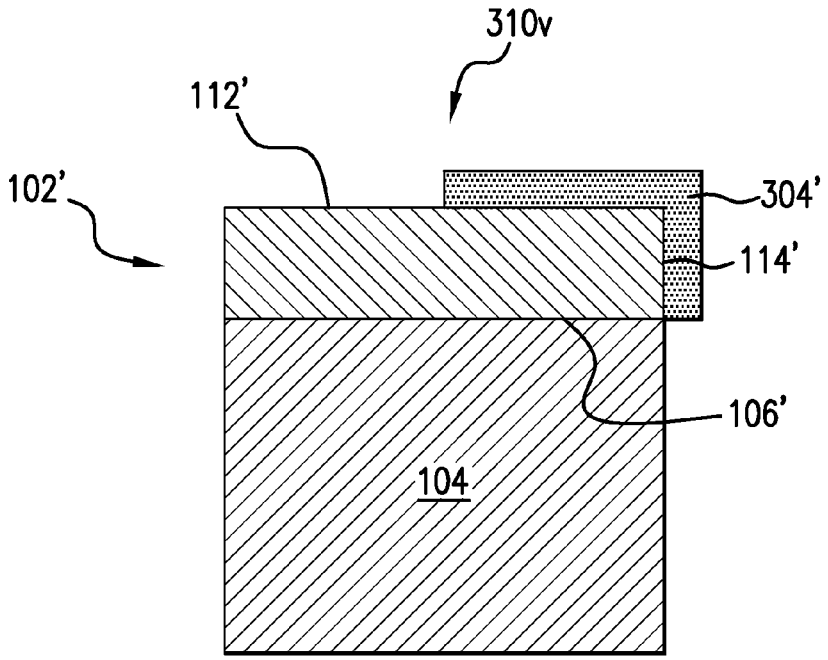
FIG. 3V is a cross-sectional view of an embodiment of a precursor assembly.
Figure 3W:
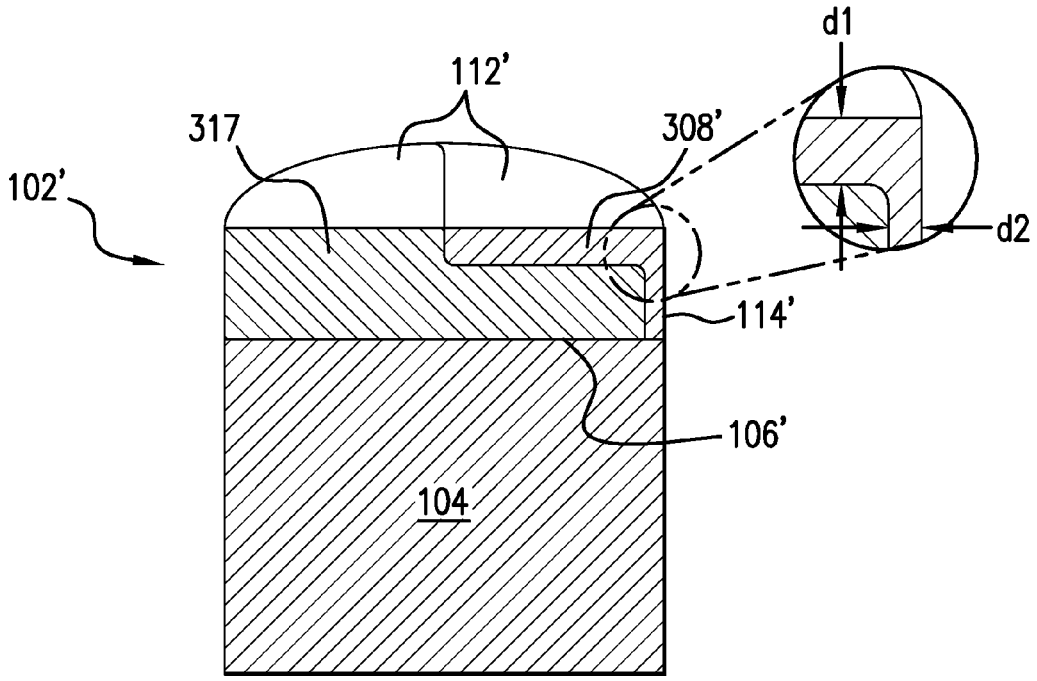
FIG. 3W is an isometric cross-sectional view of an embodiment of a PDC after processing the precursor PDC assembly shown in FIG. 3V.

In some embodiments, a body of at least one material 304' may be disposed on 50% or less of the surface area of the upper surface 112' and/or the side surface 114' of the PCD table 102'. For example, the first region 308' may include a first portion extending substantially parallel to at least a portion of the side surface 114' and a second portion extending substantially parallel to at least a portion of the upper surface 112'. Referring to FIG. 3V, in an embodiment of a cell assembly 310*r*, the at least one material 304' may be in the form of a layer or coating extending along about half of the surface of upper surface 112' and extending along about half of the side surface 114" so that the at least one alloying element diffuses into the at least one Group VIII metal in selected location(s) of the PCD table 102'. For example, as shown, the body of the at least one material 304' may be positioned on top of the PDC table 102' extending along about half of the surface of upper surface 112' (e.g., a half circle) and along about half of the side surface 114' (e.g., half of a generally annular body) of the PCD table 102'. FIG. 3W illustrates one embodiment of a resultant structure of the PCD table 102' after performing the second stage heating process on the structure shown in FIG. 3V in which the at least one alloying element of the at least one material 304' diffuses into the PCD table 102' to form the first region 308' and in which the at least one Group VIII metal thereof is alloyed with the at least one alloying element. As shown, the at least one alloying element may diffuse into the PCD table 102' to form the first region 308' extending about at least a portion of a second region 317 having substantially no alloying element therein. In some embodiments, the depth to which the at least one alloying element may diffuse into the PCD table 102' may be substantially uniform or may vary between the portions of the first region 308' adjacent to the upper surface 112' and the side surface 114'. For example, the portion of the first region 308' adjacent to the side surface 114' may exhibit a depth $d_2$ of about 50% less than a depth $d_1$ of the portion of the first region 308' adjacent to the upper surface 112', such as about 50% to about 100%, about 60% to about 80% or about 75% less. In an embodiment, the portion of the first region 308' adjacent to the side surface 114' may exhibit a depth $d_2$ as measured from the side surface 114' of about 50% or more than the depth $d_1$ of the portion of the first region 308' adjacent to the upper surface 112', such as about 50% to about 100%, about 60% to about 80% or about 75% more. In an embodiment, the depth of diffusion of the at least one alloying element adjacent to one or both of the upper surface 112' or side surface 114' may be at least about 250 μm, about 400 μm to about 700 μm, or about 600 μm to about 800 μm. In such embodiments, more of the at least one allying element may be disposed adjacent to a particular portion of the surface of the PCD table than is positioned adjacent to a second portion of the surface of the PCD table 102. For example, in an embodiment, at least double the amount (e.g., thickness or concentration) of the at least one alloying element may be disposed along the side surface 114" than is disposed along the upper surface 112" of the PCD table 102'.

In an embodiment, the thickness of the first region 308' may be dependent upon the thickness of the at least one material 304' disposed on or adjacent to the PCD table 102'. For example, the first region 308 or 308' may extend (e.g., from the upper surface 112' or the side surface 114') a distance or depth of at least about at least about 250 μm, about 250 μm to about 500 μm, about 400 μm to about 700 μm, or about 600 μm to about 800 μm. In an embodiment, the first region 308' may include a first portion having a substantially uniform first depth (e.g., thickness) and a second portion having a substantially uniform second depth. The depths of the first portion and the second portion may be substantially equal to or different than each other.

Figure 3X:
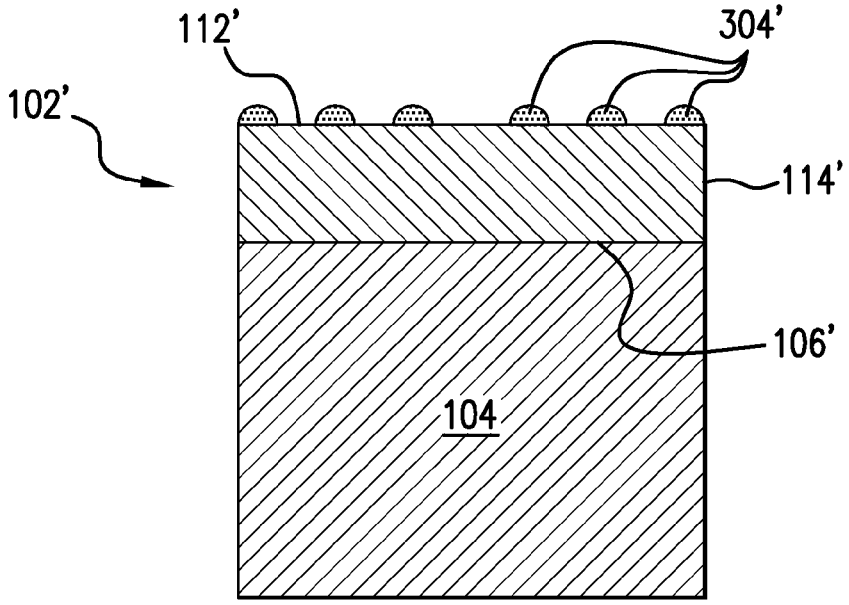
FIG. 3X is a cross-sectional view of an embodiment of a precursor assembly.
Figure 3Y:
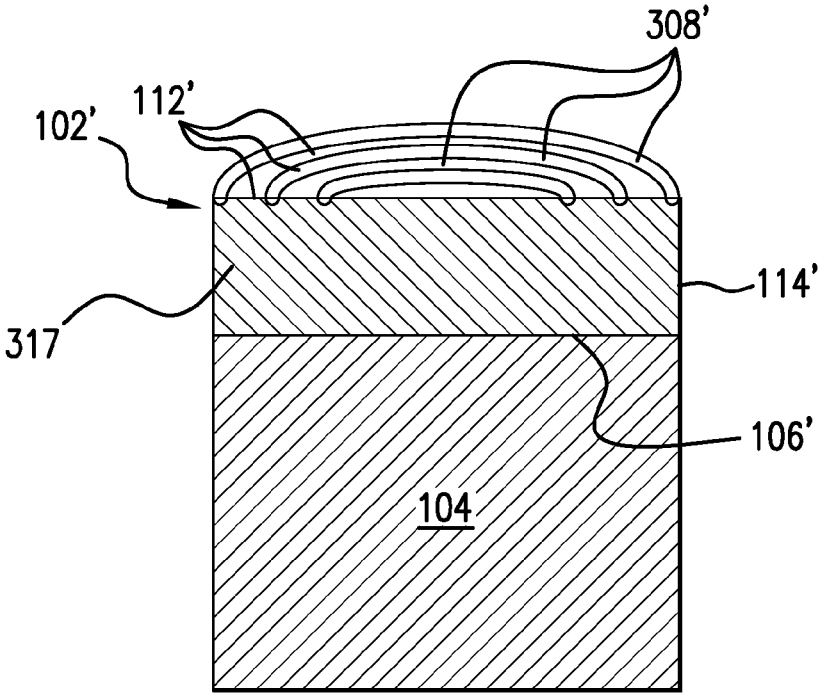
FIG. 3Y is an isometric cross-sectional view of an embodiment of a PDC after processing the precursor PDC assembly shown in FIG. 3X.

In some embodiments, one or more discrete, non-intersecting regions having the at least one alloying element therein may be formed in a PCD table 102'. For example, the one or more regions may be linear, circular, generally annular, amorphous, rectangular, or exhibit any other suitable geometric configuration. The one or more discrete, non-intersecting regions may form a pattern, be regularly spaced, or be irregularly spaced. Referring to FIG. 3X, in an embodiment of a cell assembly 310*r*, the at least one material 304' may be in the form of discrete sections of the at least one material 304' so that the at least one alloying element diffuses into the at least one Group VIII metal in selected location(s) of the PCD table 102'. For example, as shown, concentric rings of the at least one material 304' may be positioned on top of the PDC table 102' extending thereabout at or near the side surface 114' of the PCD table 102' inward. FIG. 3Y illustrates one embodiment of a resultant structure of the PCD table 102' after performing the second stage heating process on the structure shown in FIG. 3X and in which the at least one alloying element of the at least one material 304' diffuses into the PCD table 102' to form a plurality of circumferentially-spaced first regions 308' in which the at least one Group VIII metal thereof is alloyed with the at least one alloying element. As shown, the at least one alloying element may diffuse into the PCD table 102' to form the plurality of circumferentially-spaced first region 308' concentrically extending from the side surface 114' about at least a portion of the upper surface 112' of the PCD table 102', with each of the concentric first regions 308' being spaced apart by a generally annular portion of the second region 317 having substantially no alloying element therein. The width of the at least one material 304' may be dependent upon the desired size or width of the resulting first region 308', and may vary. For example, in an embodiment, the desired first regions 308' may exhibit a concentrically increasing or decreasing width and therefore the at least one material 304' may be positioned having a substantially similar configuration on the PCD table 102'. In some embodiments (not shown), regions 308 may at least partially overlap despite the at least one material 304' being discrete and separate prior to alloying.

Still further geometric configurations for the first region are considered herein. For example, a plurality of rows (e.g., parallel rows) or discrete dots (e.g., checkerboard pattern) of the at least one material may be disposed on one or more surfaces of the PCD table 102' to provide a resulting plurality of rows or discrete dot regions in the PCD table having the at least one alloying element therein.

In some embodiments (not shown), different alloying elements may be disposed in different portions of the same PCD table. For example, in an embodiment, a cell assembly may include a first at least one alloying element (e.g., boron) adjacent to the upper surface of the PCD table in a central region, such as depicted in FIG. 3R. The cell assembly may further include a second at least one alloying element (e.g., phosphorous) adjacent to the surface of the PCD table in an outer region such as depicted in FIG. 3D. A resulting PCD table may include an inner or central portion including the first at least one alloying element at least partially surrounded by an outer or generally annular portion including the second at least one alloying element. In some embodiments, the resulting PCD table may include regions of differing alloying elements that at least partially overlap. A different alloying element may include: a chemical element different from those found in a first alloying element, or a different alloy (e.g., different component composition percentages) containing at least one element in common with another alloying element. In an embodiment, a cell assembly may include a plurality of concentric portions such as shown in FIG. 3X. Each concentric portion may include different alloying element from one or more of the other concentric portions, such as an adjacent concentric portion. The resulting PCD table may include a series of concentric regions having differing alloying elements therein, or at least partially overlapping concentric regions having different alloying elements therein.

Figure 3Z:
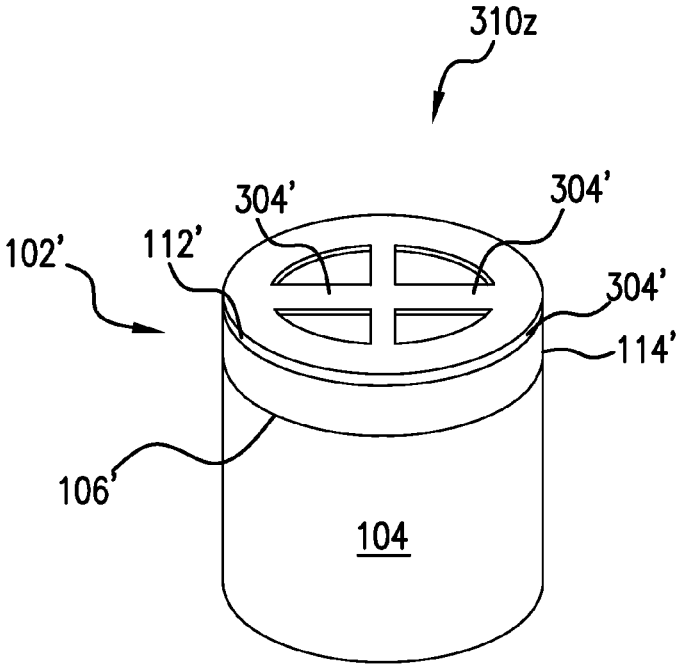
FIG. 3Z is an isometric view of an embodiment of a precursor assembly.
Figure 3Z:
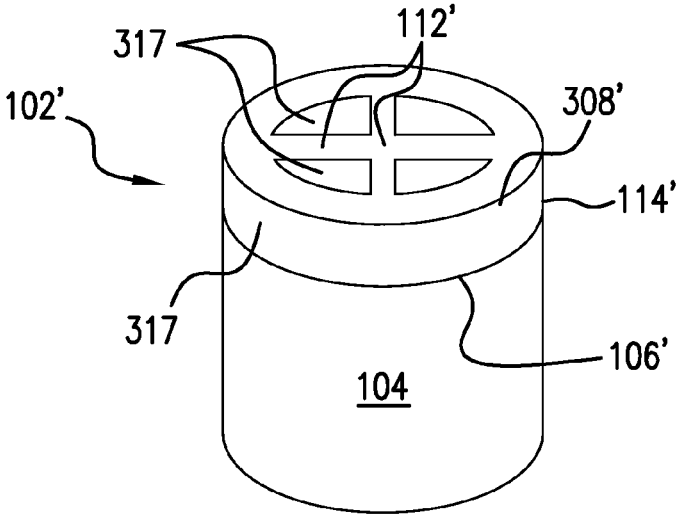

In an embodiment, a cell assembly or PCD table may include portion or region having a first alloying element substantially configured according to any of the embodiments herein. The cell assembly or PCD table may also include at least second a portion or region having the second, different alloying element substantially in a configuration according to any of the embodiments herein. Subjecting the cell assembly to a high-pressure/high-temperature process may include forming one or more different alloys corresponding to the different alloying elements. The resulting PCD table may include at least first and second regions having differing alloying elements or alloys therein, such as a different intermediate compounds having different crystal structures and/or compositions. The resulting PCD table may include at least first and second regions partially overlapping and having differing alloying elements or alloys therein, such as a different intermediate compounds. Referring to FIG. 3Z, in an embodiment of a cell assembly 310*r*, the at least one material 304' may be in the form of a modified disc having apertures formed therein so that the at least one alloying element diffuses into the at least one Group VIII metal in selected location(s) of the PCD table 102'. For example, as shown, the body of the at least one material 304' may be positioned on top of the PDC table 102' extending thereabout at or near the side surface 114' of the PCD table 102'. FIG. 3ZZ illustrates one embodiment of a resultant structure of the PCD table 102' after performing the second stage heating process on the structure shown in FIG.

3Z in which the at least one alloying element of the at least one material 304' diffuses into the PCD table 102' to form the first region 308' and in which the at least one Group VIII metal thereof is alloyed with the at least one alloying element. As shown, the at least one alloying element may diffuse into the PCD table 102' to form the first region 308' extending about at least one or more portions of a second region 317 having substantially no alloying element therein. In FIG. 3ZZ, the resulting first region 308' of the PCD table 102' exhibits a generally annular portion extending about the upper surface 112' the PCD table 102' from the side surface 114' inward and having one or more (e.g., four) radially extending portions (e.g., spokes) therein. The radially extending spokes may extend from the center of the upper surface 112' outward. The resulting first region 308' may have one or more portions of the second region 317 therebetween. The width and depth of the radially extending portions and generally annular portion may vary depending upon the desired properties of the PCD table 102'. For example, the width of the radially extending portions may be substantially the same as, greater than, or less than the width of the generally annular portion. The width of any of the generally annular portions or generally annular bodies herein may be greater than about 0.01 inches, such as about 0.01 inches to about 0.25, inches, about 0.05 inches to about 0.2 inches, about 0.075 inches to about 0.15 inches, or about 0.1 inches. The depth of diffusion in any of the portions of any of the first regions disclosed herein may be at least about 250 μm, about 400 μm to about 700 μm, about 600 μm to about 800 μm, or more than about 1000 μm. In an embodiment, the first region 308' may only include one or more radially extending portions without a generally annular portion.

It should be noted that in other embodiments, the at least one alloying element may be mixed with the diamond particles in powder form prior to sintering the diamond particles. For example, at least one alloying element powder having an average particle size of about 1 μm to about 20 μm, such as about 1 μm to about 7 μm may be mixed with the diamond particles in addition to or as an alternative to employing the at least one material 304 and 304'.

Figure 4A:
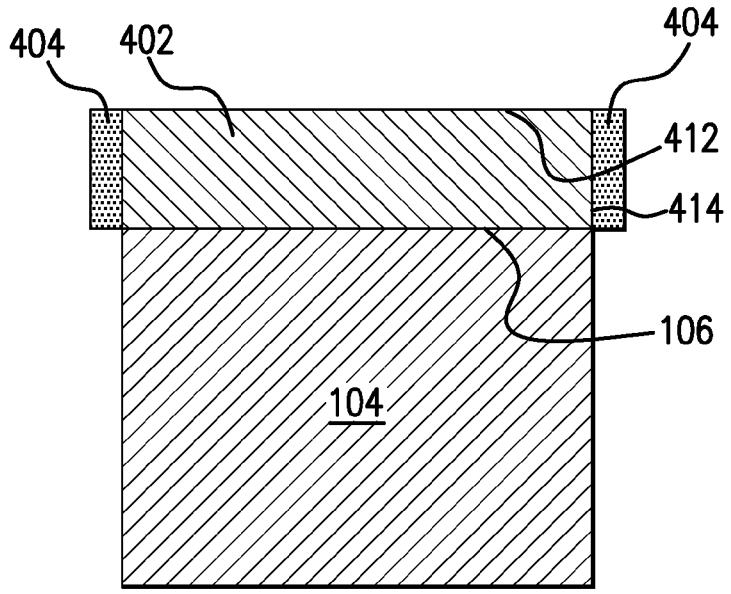
FIG. 4A is an isometric view of an embodiment of an assembly.

As noted above, the at least one material may be disposed adjacent to or mixed within diamond particles prior to or contemporaneous with formation of the PCD table. FIG. 4A is a cross-sectional view of an assembly 400 during the fabrication of a PDC according to an embodiment. The assembly 400 and components thereof may be identical or similar to assembly 300 and components thereof discussed above with reference to FIG. 3A. For example, the assembly 400 includes a mass of diamond particles 402 that may be the identical or similar to the mass of particles 302, including any diamond particle sizes, layer thicknesses, or shapes, etc. The mass of diamond particles may be pre-compacted into a green state part having an upper surface 412, a lower surface (e.g., interfacial surface), and a side surface 414 therebetween.

The assembly 400 may include a substrate 104, which may be identical or similar to any substrate 104 described herein (e.g., with respect to any of composition, shape, and/or interfacial surface 106). The mass of diamond particles 402 may be positioned on the interfacial surface 106 of the substrate 104. The at least one material 404 includes any of the alloying elements disclosed herein (e.g., at least one alloying element that lowers a temperature at which melting of at least one Group VIII metal begins). For example, the at least one material 404 may be in the form of particles of the alloying element(s), a thin disc of the alloying element(s), a green body of particles of the alloying elements(s), at least one material of the alloying element(s), or combinations thereof. In some embodiments, the at least one alloying element may even comprise carbon in the form of at least one of graphite, graphene, fullerenes, or other $sp^2$-carbon-containing particles. In an embodiment, the at least one material 404 may include phosphorus such as in the form of particles of phosphorous, a thin disc of phosphorous, a green body of particles of phosphorous, a mixture or alloy of the Group VIII metal and phosphorous in disc or powder form, or combinations thereof. The phosphorous may be any form phosphorous disclosed herein.

The at least one material 404 may be disposed on the diamond particles 402 in any configuration disclosed above for the at least one material 304. The at least one material 404 may be positioned on at least a portion of the side surface 414 of the mass of diamond particles 402. For example, as shown, the at least one material 404 may be in the form of a generally annular body of particles, a foil, or a layer disposed about the side surface 414.

As previously discussed, the substrate 104 may include a metal-solvent catalyst as a cementing constituent comprising at least one Group VIII metal, such as cobalt, iron, nickel, or alloys thereof. For example, the substrate 104 may comprise a cobalt-cemented tungsten carbide substrate in which cobalt is the at least one Group VIII metal that serves as the cementing constituent.

The assembly 400 may be placed in a pressure transmitting medium, such as a refractory metal can embedded in pyrophyllite or other pressure transmitting medium, and subjected to a first stage HPHT process. For example, the first stage HPHT process may include any of those first stage HPHT process conditions discussed herein, such as, at a temperature of at least about 1000° C. (e.g., about 1200° C. to about 1600° C.) and the pressure of at least 4.0 GPa (e.g., about 5.0 GPa to about 12 GPa or about 7.5 GPa to about 11 GPa) for a time sufficient to sinter the diamond particles to form a PCD table.

In an embodiment, during the first stage HPHT process, the at least one Group VIII metal from the substrate 104 or another source (e.g., metal-solvent catalyst mixed with the diamond particles) liquefies and infiltrates into the mass of diamond particles 402 and sinters the diamond particles together to form a PCD table having diamond grains exhibiting diamond-to-diamond bonding (e.g., $sp^3$ bonding) therebetween with the at least one Group VIII metal disposed in the interstitial regions between the diamond grains. In an embodiment, the at least one alloying element from the at least one material 404 does not melt during the first stage HPHT process (e.g., sintering conditions) and/or is enclosed within a protective enclosure or behind a protective partition (e.g., metal film, foil, material layer, etc.) made from a material that does not infiltrate the diamond particles during the first stage HPHT process regardless of the melting temperature of the at least one material 404. Thus, in this embodiment, the at least one alloying element and/or protective partition or enclosure has a melting temperature or range greater than the at least one Group VIII metal (e.g., cobalt) that is used. Suitable materials for the protective partition or enclosure may include any of those disclosed above with respect to a protective partition or enclosure. In an embodiment, if the substrate 104 is a cobalt-cemented tungsten carbide substrate, cobalt from the substrate 104 may be liquefied and infiltrate the mass of diamond particles 402 to catalyze formation of the PCD table, and the cobalt may subsequently be cooled to below its melting point or range. Then, the temperature of the second stage heating process (e.g., alloying conditions) may be increased (e.g., to about 1850 to about 1900° C.) to diffuse the at least one alloying element into the at least one Group VIII metal (e.g., while the at least one Group VIII metal is liquefied). The second stage heating process may include any of those second stage heating process conditions discussed herein (e.g., pressure and/or temperature). In an embodiment, the protective partition or enclosure may be melted or at least softened to promote diffusion of the at least one alloying element therein (e.g., boron, phosphorous, silicon, etc.) into the at least one Group VIII metal during the second stage heating process. During the second stage heating process, the at least one alloying element may alloy with the at least one Group VIII metal substantially through the entire PDC table or to a depth therein as measured from the outer surface of the PCD table.

In an embodiment, the pressure and/or temperature of the second stage heating process may be chosen responsive to the specific alloying element used in order to promote diffusion and/or alloying of the at least one alloying element into the PCD table 102' to a selected depth measured from the upper surface 412' and/or side surface 414', such as at least 250 μm, at least about 250 μm, about 400 μm to about 700 μm, about 600 μm to about 800 μm, or greater than 1000 μm.

Figure 4B:
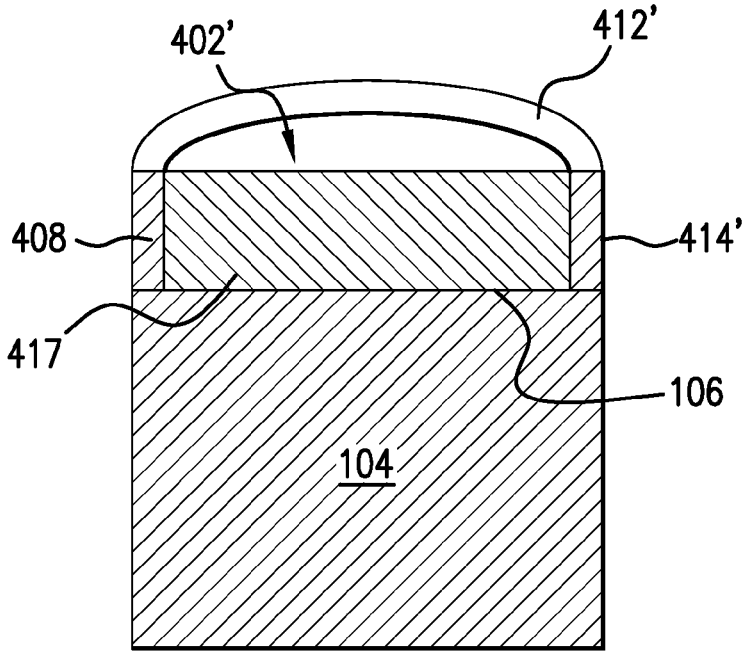
FIG. 4B is an isometric cross-sectional view of an embodiment of a PCD after processing the assembly shown in FIG. 4A.

Referring to FIG. 4B, an embodiment of a resulting sintered PCD table 402' includes bonded diamond grains exhibiting diamond-to-diamond bonding (e.g., $sp^3$ bonding) therebetween, with at least one Group VIII metal (e.g., cobalt) disposed interstitially between the bonded diamond grains (either without or without the presence of at least one alloying element therein) in at least a portion or region thereof. For example, as shown, the PCD table 402' may include a first region 408 including the at least one alloying element from the at least one material 404 and a second region 417 including the at least one Group VIII metal and no alloying element or a substantially reduced amount of alloying element (e.g., about 25% or less than the total amount in the first region) therein. The resulting PCD table 402' may include an upper surface 412', a lower interfacial surface, and a side surface 414'. As shown, the first region 408 may extend inward from the side surface 414' a distance, thereby defining a generally ring-shaped or peripheral first region 408 having the at least one alloying element therein. In some embodiments, the first region 408 may additionally or alternatively extend inwardly along the upper surface 412'. The first region 408 may at least partially enclose, cover, or surround at least a portion of the second region 417. In an embodiment, subsequent to HPHT processing, the PCD table 402' may be further processed (e.g., milled, lased, ground, EDM, etc.) to include a peripherally extending chamfer (not shown) between the upper surface 412' and the side surface 414' around at least a portion of the PCD table 402'.

It should be noted that in embodiments, the at least one alloying element may be mixed with the diamond particles in powder form prior to sintering the diamond particles. For example, at least one alloying element powder having an average particle size of about 1 μm to about 20 μm, such as about 1 μm to about 7 μm may be mixed with the diamond particles in addition to or as an alternative to employing the at least one material 304, 304', or 404, In some embodiments, subsequent to PCD table formation and diffusion of the at least one alloying element therein, the PCD table may be leached. In another embodiment, the PCD table (e.g., bonded to a substrate) may be formed, leached, and then alloyed with at least one alloying element. For example, any of the PCD tables 102, 102', 302', or 402' may be leached to remove at least a portion of the at least one alloying element and/or at least one Group VIII metal therefrom, such as the metallic interstitial constituent. Leaching may remove the at least one alloying element, at least one Group VIII metal, the alloy, or combinations thereof from the interstitial regions of the PCD table to a depth or distance from the upper surface 412' or the side surface 414'. The resulting leached region 422 may exhibit a leach depth 423 of about 250 μm or more from the upper surface 412' or side surface 414' of the PCD table 402', encompassing one or more of the first or second regions, 408 or 417. Generally, a maximum leach depth may be greater than 250 μm. For example, the leach depth 423 for the leached region 422 may be about 300 μm to about 425 μm, about 250 μm to about 400 μm, about 350 μm to about 400 μm, about 350 μm to about 375 μm, about 375 μm to about 400 μm, about 500 μm to about 650 μm, about 600 μm to about 800 μm, about 800 μm to about 1000 μm, or greater than 1000 μm.

Figure 4C:
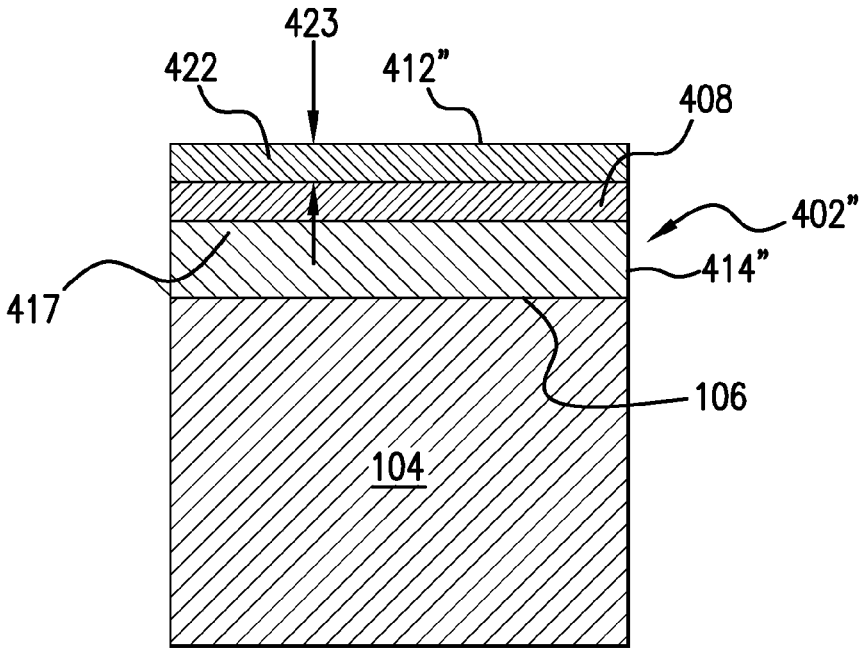
FIG. 4C is a cross-sectional view of an embodiment of a partially leached PDC.
Figure 4D:
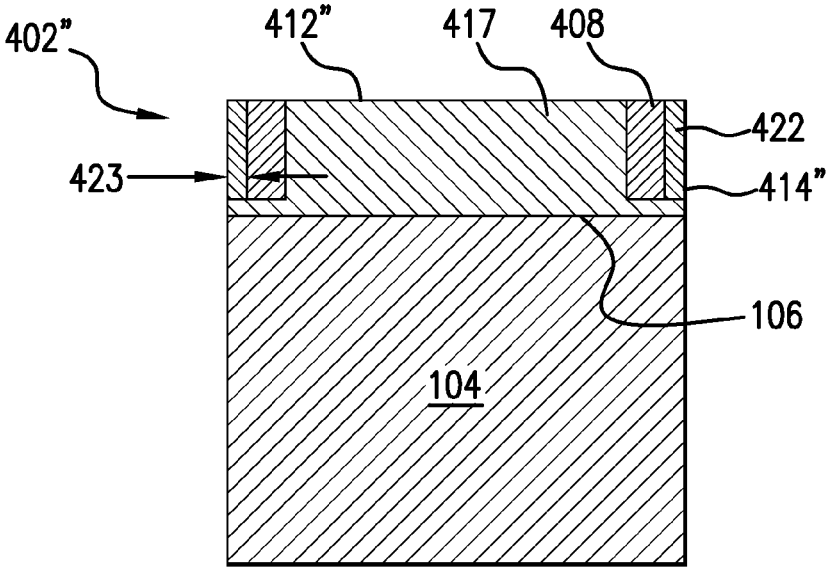
FIG. 4D is a cross-sectional view of an embodiment of a partially leached PDC.
Figure 4E:
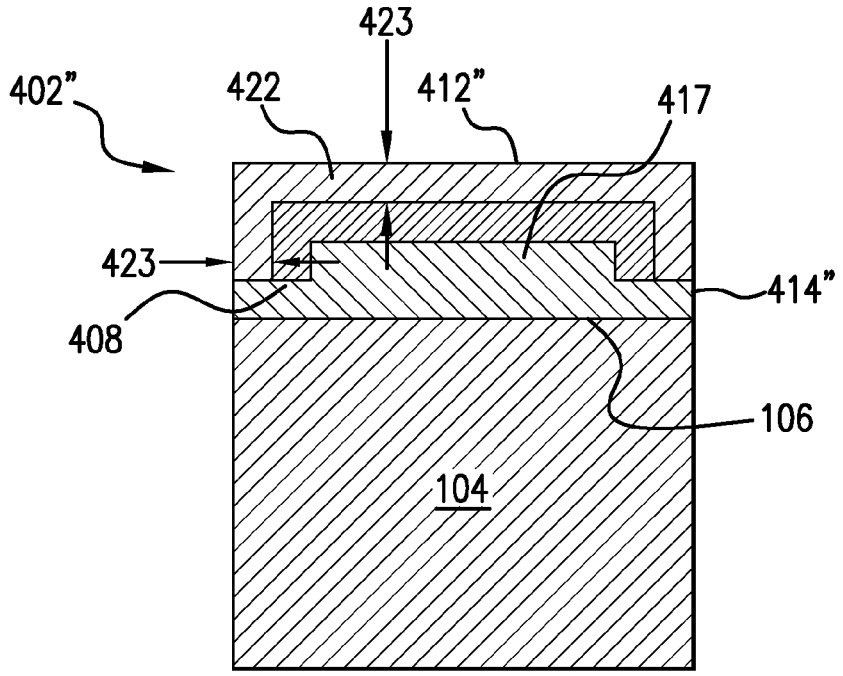
FIG. 4E is a cross-sectional view of an embodiment of a partially leached PDC.

Referring specifically to the cross-sectional view of FIGS. 4C-4F, in an embodiment, the PCD table 402' may be leached to improve the thermal stability and/or wear resistance thereof. The leached PCD table 402" includes first region 408 including the metallic interstitial constituent having any of the alloys disclosed herein, and a second region 417 adjacent to the interfacial surface 106 of the substrate 104 that includes at least one Group VIII metal in the interstitial regions thereof and substantially free of the alloy. The PCD table 402" further includes a leached region 422 that may extend inwardly from one or more of the upper surface 412", a chamfer (not shown), and a portion of the side surface 414". The leached region 422 extends inwardly to a selected depth or depths from the upper surface 412", and a portion of the at least one side surface 414", and when present, the chamfer. As shown in FIGS. 4C-4E, the first region 408 extends between at least a portion of the second region 417 and the leached region 422. Such a configuration may provide a graduated level or transition region between different levels of residual stress, wear resistance, thermal stability, or combinations thereof to the PCD table 402" so formed.

The leached region 422 has been leached to substantially deplete the metallic interstitial constituent therefrom that previously occupied the interstitial regions between the bonded diamond grains of the leached region 422. The leaching may be performed in a suitable acid (e.g., aqua regia, nitric acid, hydrofluoric acid, or combinations thereof) so that the leached region 422 is substantially free of the catalyst and/or metallic interstitial constituent. As a result of the metallic interstitial constituent (e.g., a Group VIII metal-alloying metal alloy such as a cobalt-phosphorus alloy) being at least partially depleted from the leached region 422, the leached region 422 is relatively more thermally stable than the underlying second region 417. The leaching process may be carried out for a selected time, with a selected acid (e.g., type of acid and/or concentration of acid), or by selective immersion in the acid to produce a desired leach depth 423, as measured from one or more of the upper surface 412" or the side surface 414"). Additionally, different configurations of leached regions 422 may be made using masking and/or selective immersion techniques as disclosed in U.S. patent application Ser. Nos. 12/555,715 and 13/751,405 which are incorporated herein, in their entirety, by this reference.

Referring to FIG. 4C, the PCD table of FIG. 3W may be at least partially leached from one or more surfaces, such as the upper surface as shown. The leached region 422 extends across the upper surface of the PCD table 402" inward to a leach depth 423 therein. The second region 417 extends from the interfacial surface 106 of the substrate 104 to the leached region 422 in a portion of the PCD table 402". The first region 408 extends across at least a portion of the side surface 414" inward to a depth therein and, as shown, between at least a portion of the leached region 422 and the second region 417. For example, the first region 408 extends around half of the side surface 414" and horizontally between about half of the leached region 422 and the second region 417, such as in the half circle configuration shown.

The leached region 422 may encompass at least a portion of the depth of the former first region 408 from which the at least one alloying element and/or at least one Group VIII material are removed during leaching. For example, the leached region 422 may extend into the PCD table 402" more than about 10% of the depth (as measured from one or more of the upper surface 412" or the side surface 414") that the first region 408 extends to, such as about 20% to about 80%, about 25% to about 75%, about 30% to about 60%, about 50%, or less than about 80% of the depth that the first region 408 extends to. In an embodiment, the first region 408 may extend about 800 μm into the PCD table 402" and the leached region 422 may extend about 500 μm into the PCD table 402". In an embodiment, the first region 408 may extend about 800 μm into the PCD table 402" and the leached region 422 may extend about 400 μm into the PCD table 402". In an embodiment, the first region 408 may extend about 850 μm into the PCD table 402" and the leached region 422 may extend about 250 μm into the PCD table 402".

Referring to FIG. 4D, the PCD table of FIG. 3H may be leached from one or more surfaces, such as the side surface 414" as shown. In the embodiment shown, the leached region 422 extends along the side surface 414" and extends inwardly to the leach depth 423 in the PCD table 402", thereby forming a generally annular shape. The second region 417 extends from the interfacial surface 106 of the substrate 104 to the upper surface 412", with the second region 417 within the generally annular shaped leached region 422. The first region 408 extends substantially parallel to and between the leached region 422 and the second region 417. The first region 408 and leached region 422 may extend inward any of the respective depths described herein.

Referring to FIG. 4E, the PCD table may be leached from both the upper surface 412" and the side surface 414" as shown. The leached region 422 extends across the upper surface 412" and the side surface 414" of the PCD table 402" inward to the leach depth 423 therein. The second region 417 extends generally vertically and generally horizontally from the interfacial surface 106 of the substrate 104 toward the leached region 422. The first region 408 extends between the leached region 422 and the second region 417 and extends substantially contours the leached region 422. The leached region 422 may exhibit any suitable leach depth 423 disclosed therein. In some embodiments, the leach depth 423 at side surface 414" may be greater than, equal to, or less than the leach depth 423 at the upper surface 412". In the illustrated embodiment, the leached region 422 and the first region 408 are illustrated with standoff from the substrate 104. However, in other embodiments, the leached region 422 and the first region 408 may extend to the substrate 104.

Figure 4F:
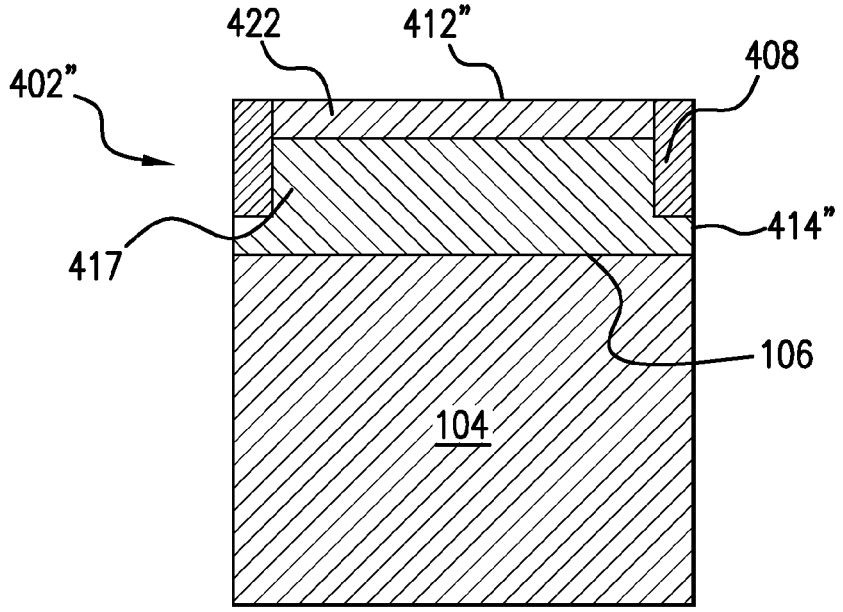
FIG. 4F is a cross-sectional view of an embodiment of a partially leached PDC.

Referring to FIG. 4F, the first region 408 extends along the side surface 414" (e.g., from the interfacial surface 106 of the substrate to the upper surface 412" about the lateral periphery of the PCD table 422), the second region 417 extends from the interfacial surface 106 toward the upper surface 412", and the leached region 422 may extend inward from the upper surface 412" inside of the first region 408. The leached region 422 may exhibit any suitable leach depth 423 disclosed herein. Formation of the leached region 422 may be accomplished by masking the first region 408 of PCD table and leaching the selected area to produce the leached region 422 by such techniques as disclosed in U.S. patent application Ser. Nos. 12/555,715 and 13/751,405 each of which is incorporated herein by reference above. In the illustrated embodiment, the first region 408 is illustrated with standoff from the substrate 104. However, in other embodiments, the first region 408 may extend to the substrate 104.

A method of fabricating a PDC may include an act of providing an assembly and an act of subjecting the assembly to a heating condition (e.g., higher than ambient temperature) effective to alloy an alloying element therein. The heating condition may include a higher than ambient temperature condition effective to at least partially alloy the alloying element. The assembly may be configured identical or similarly to any assembly disclosed herein. In an embodiment, the assembly may include a substrate and a PCD table bonded to the substrate. The PCD table may include an upper surface, at least one side surface, an interfacial surface bonded to the substrate, and a plurality of bonded diamond grains defining a plurality of interstitial regions. At least a portion of the plurality of interstitial regions may include at least one Group VIII metal disposed therein. The assembly may include at least one material positioned adjacent to the PCD table. For example, the at least one material may include phosphorous. In an embodiment, the assembly may include at least another material adjacent to the PCD table, such as the at least another material may differ from the at least one material (e.g., alloying material) in one or more of composition or concentration. The at least another material may include any of those materials disclosed above for the at least one alloying element.

In an embodiment, providing an assembly may include positioning at least one material adjacent to at least a portion of one or more of the upper surface or the at least one side surface. In an embodiment, the layer of least one material may be positioned adjacent to more than about 50% of the surface area of one or more of the upper surface or the at least one side surface.

The method may further include an act of subjecting the assembly to a heating condition (e.g., high-temperature condition, second stage heating condition, or higher than ambient temperature condition) effective to at least partially alloy the at least one Group VIII metal with the alloying element (e.g., phosphorous) to form an alloy. The alloy may exhibit a bulk modulus that is less than that of the at least one Group VIII alone. For example, suitable temperature process conditions may include any of the second stage heating conditions disclosed herein. Subjecting the assembly to the heating condition may include subjecting the assembly to high pressures, ambient pressure, or reduced pressure (e.g., vacuum), similar or identical to any of the foregoing pressure/temperature conditions disclosed herein including any HPHT process conditions disclosed herein.

The alloy so formed may include at least one intermediate compound of the at least one Group VIII metal and the phosphorous. The resulting PCD table may include a first region extending inwardly from the upper surface and the at least one side surface that includes the at least one intermediate compound therein and a second region extending inwardly from the interfacial surface that is substantially free of phosphorous. In an embodiment when another material is disposed in the assembly, subjecting the assembly to a heating condition (e.g., high-temperature process conditions, a higher than ambient temperature condition, or HPHT process conditions) may include forming another alloy including at least another intermediate compound comprising the at least another material and the group VIII metal. In some embodiments, the one or more portions of the PDC may be further processed to a final dimension after alloying the at least one material therein.

The method may further include an act of leaching at least a portion of the PCD table. Leaching can be carried out prior to forming the alloy. Leaching may be carried out after forming the alloy. Leaching can be carried out to depth from one or more surfaces of the PCD table. For example, the PCD table may be leached to a depth of at least about 50 μm, such as 50 μm to about the full thickness of the PCD table, about 100 μm to about 500 μm, or at least about 250 μm from one or more of the upper surface or at least one side surface. In an embodiment, leaching may be carried out after forming the alloy. In such embodiments, leaching may remove at least some of the alloy.

In some embodiments, the one or more portions of the PDC may be further processed (e.g., ground, lased, lapped, etc.) to a final dimension after alloying the at least one material therein. However, such processing can remove at least a portion of the PCD table containing the beneficial alloy.

Figure 5:
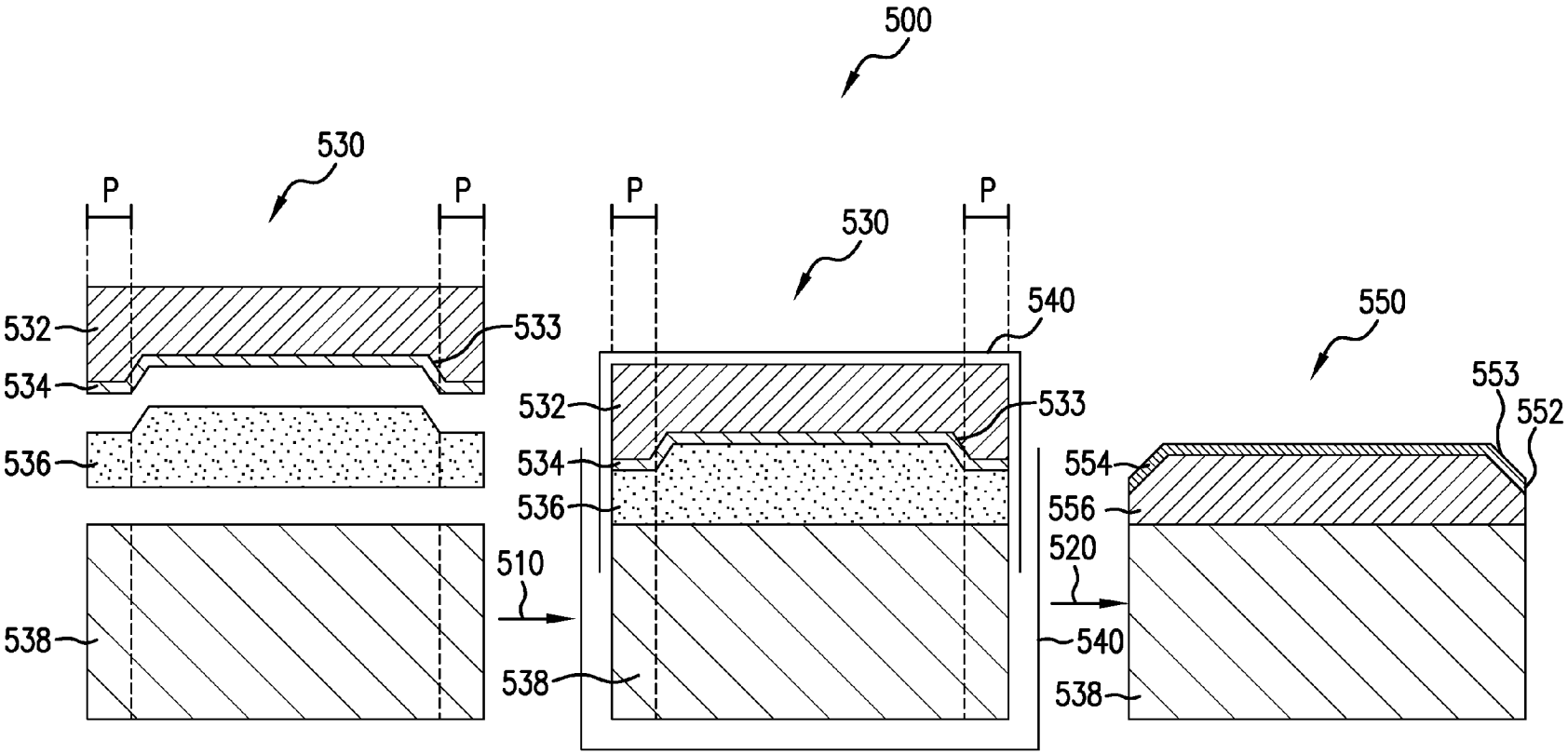
FIG. 5 is a schematic flow diagram of a method of making a PDC according to another embodiment.

FIG. 5 is a schematic flow diagram of an embodiment of a method 500 of making a PDC. The method includes using an assembly 530 including a pre-shaped shaping medium 532 (e.g., a slug or mold) to form a PDC having a PCD table exhibiting final dimensions close to a desired dimension of the PCD table such that subsequent processing is at least minimized or not needed. The method includes an act 510 of providing an assembly 530. The assembly 530 may include a pre-shaped shaping medium or slug 532 having an approximately negative impression of the desired dimensions of one or more surfaces of the finished PCD table to be formed. The pre-shaped shaping medium 532 may be made of any material capable of maintaining a shape at the pressures and temperatures used in HPHT processing as described herein. Suitable materials for the pre-shaped shaping medium 530 may include hexagonal boron nitride ("HBN"). For example, the HBN may be sintered HBN or cold-pressed HBN powder. The pre-shaped shaping medium 532 may exhibit a negative impression having one or more contours therein configured to provide a desired finished PCD shape. In an embodiment, the pre-shaped shaping medium 532 may have a chamfer 533 formed therein to provide a chamfer for the finished PCD table.

The pre-shaped shaping medium 532 may include at least one layer/region or a plurality of layers/regions of at least one material 534 (e.g., alloying element) on a surface of the pre-shaped shaping medium 532 positioned adjacent to diamond powder in the assembly 530. The layer(s)/region(s) of at least one material 534 may be adhered or coated onto the pre-shaped shaping medium 532. The layer(s)/region(s) of at least one material 534 may be applied to the pre-shaped shaping medium 532 by one or more of pressing, painting, dip-coating, adhesive, impregnation, sputtering, or spraying. For example, a suitable binder may be applied to the pre-shaped shaping medium 532 followed by applying the at least one material 534 in powder form, which bonds to the pre-shaped shaping medium 532 via the binder. This application/binding process may be repeated multiple times until a desired number of layer(s)/regions of the powdered at least one material 534/alloying material is formed on the pre-shaped shaping medium 532. Optionally, the pre-shaped shaping medium 532 may be heated to vaporize and remove the binder from the pre-shaped shaping medium 532 (e.g., prior to incorporating the pre-shaped shaping medium 532 into the assembly 530). The thickness of each layer or the multiple layer(s)/regions of the at least one material 534 may be substantially uniform and at least about 10 nm thick, such as about 10 nm to about 100 μm, about 100 nm to about 300 μm, or at least about 1 μm thick. The layer(s)/region of at least one material 534 may include any of the alloying elements disclosed herein, such as boron and/or phosphorus.

The assembly 530 may further include one or more layers or regions of diamond powder 536 that abuts the layer(s) of at least one material 534 and underlying pre-shaped shaping medium 532, filling in or at least partially taking on the shape of the pre-shaped shaping medium 532. The diamond powder in the layer of diamond powder 536 may be similar or identical to any diamond powder disclosed herein, including but not limited to diamond particle size distributions, diamond particle sizes, or catalyst content. The assembly 530 may include a substrate 538 positioned adjacent to (e.g., below) the diamond powder 536. The substrate 538 may be similar or identical to any substrate disclosed herein. The assembly 530 may be placed in a refractory metal container 540 which may be placed in a pressure transmitting medium for HPHT processing.

The method 500 includes an act of subjecting the assembly 530 to HPHT conditions effective to sinter the diamond particles together and alloy the at least one material (e.g., alloying element) with another material (e.g., Group VIII catalyst) that is mixed with the diamond powder and/or infiltrated into the diamond powder during HPHT processing. For example, the at least one material may alloy with the at least Group VIII metal that is infiltrated into the diamond powder from the substrate (e.g., boron and/or phosphorous alloying with cobalt provided from a cobalt-cemented tungsten carbide substrate). The HPHT conditions may include any of the HPHT conditions disclosed herein.

The resulting PDC 550 may include a PCD table 552 bonded to the substrate 538. The PCD table 552 may exhibit a surface geometry that is complementary to the pre-shaped shaping medium 532. For example, the PCD table 552 may exhibit a surface geometry having a chamfer 553 substantially matching the chamfer 533 of the pre-shaped shaping medium 532. Accordingly, the PCD table 552 may not need to be further processed to form a chamfer therein. The PCD table 552 may include one or more regions therein. For example, the PCD table 552 may include a first region 554 extending inward from one or more outer surfaces (e.g., the upper surface, chamfer, or lateral surface) of the PCD table 552. The first region 554 may exhibit a thickness or composition identical or similar to any thickness or composition of any first region disclosed herein. For example, the first region 554 may include at least one alloy therein formed from the at least one Group VIII metal and the at least one material 534 (e.g., alloying element). The at least one alloy may be composed similarly or identical to any alloy disclosed herein. The PCD table 552 may include a second region 556 extending inward from the interface with the substrate 538. The second region 556 may exhibit a thickness or composition identical or similar to any thickness or composition of a second region disclosed herein.

In some embodiments, the outer dimensions of the PDC may be finished to size after HPHT processing. The PDC may be processed (e.g., on a centerless grinder) to remove peripheral portions thereof. However, it may remain desirable to leave one or more portions of the PCD table (e.g., cutting surface including one or more of the upper surface, lateral surface, or chamfer) in substantially the as-sintered condition or a condition requiring only minimal processing. As shown in FIG. 5, in such embodiments, one or more of the pre-shaped shaping medium 532, the at layer of at least one material 534, the diamond powder 536, or substrate 538 may include an a peripheral portion P extending about the periphery of the intended finished portion of the PCD table 552. Subsequent to HPHT processing the peripheral portion P of one or more of the resulting PDC 550 including one or both of the substrate 538 or the PCD table 552 can be removed to leave only the desired portions thereof. In an embodiment, the peripheral portion P can be removed to the chamfer 553 such that the alloy therein remains substantially intact.

Figure 6:
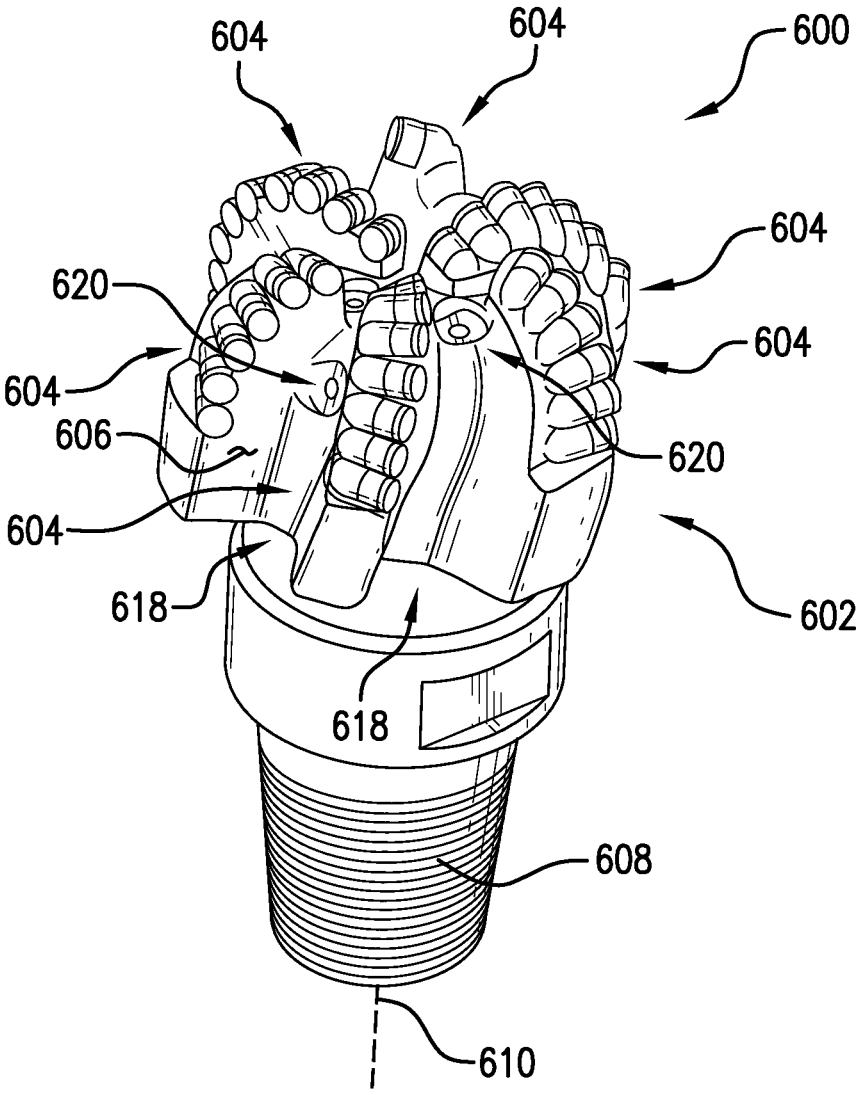
FIG. 6 is an isometric view of an embodiment of a rotary drill bit that may employ one or more of the disclosed PDC embodiments.
Figure 7:
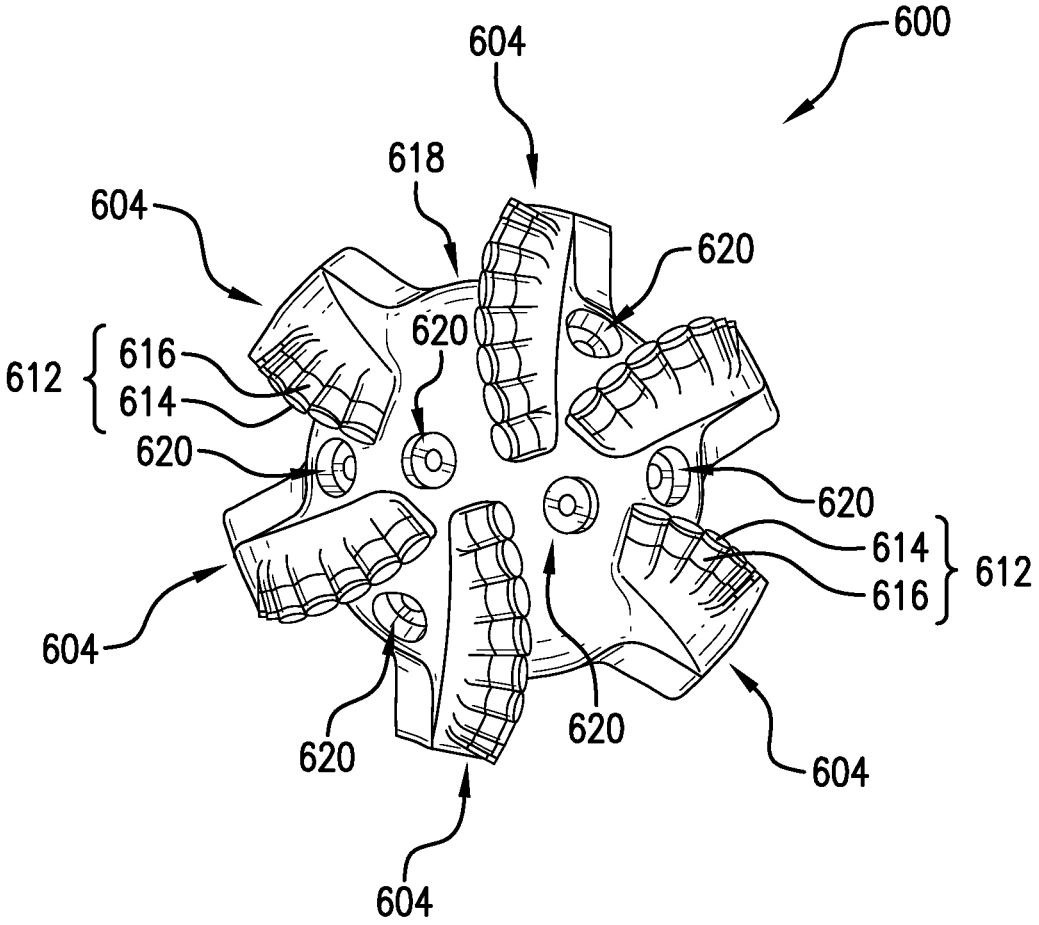
FIG. 7 is a top elevation view of the rotary drill bit shown in FIG. 6.

FIG. 6 is an isometric view and FIG. 7 is a top elevation view of an embodiment of a rotary drill bit 600 that includes at least one PDC configured according to any of the disclosed PDC embodiments. The rotary drill bit 600 comprises a bit body 602 that includes radially and longitudinally extending blades 604 having leading faces 606, and a threaded pin connection 608 for connecting the bit body 602 to a drilling string. The bit body 602 defines a leading end structure for drilling into a subterranean formation by rotation about a longitudinal axis 610 and application of weight-on-bit. At least one PDC, configured according to any of the disclosed PDC embodiments, may be affixed to the bit body 602. With reference to FIG. 6, each of a plurality of PDCs 612 is secured to the blades 604 of the bit body 602 (FIG. 6). For example, each PDC 612 may include a PCD table 614 bonded to a substrate 616. More generally, the PDCs 612 may comprise any PDC disclosed herein, without limitation. In addition, if desired, in some embodiments, a number of the PDCs 612 may be conventional in construction. Also, circumferentially adjacent blades 604 define so-called junk slots 620 therebetween. Additionally, the rotary drill bit 600 includes a plurality of nozzle cavities 618 for communicating drilling fluid from the interior of the rotary drill bit 600 to the PDCs 612.

FIGS. 6 and 7 merely depict one embodiment of a rotary drill bit that employs at least one PDC fabricated and structured in accordance with the disclosed embodiments, without limitation. The rotary drill bit 600 is used to represent any number of earth-boring tools or drilling tools, including, for example, core bits, roller-cone bits, fixed-cutter bits, eccentric bits, bi-center bits, reamers, reamer wings, or any other downhole tool including superabrasive compacts, without limitation.

The PDCs disclosed herein (e.g., PDC 100 of FIGS. 1A-1D) may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used in any apparatus or structure in which at least one conventional PDC is typically used. In one embodiment, a rotor and a stator, assembled to form a thrust-bearing apparatus, may each include one or more PDCs (e.g., PDC 100 of FIGS. 1A and 1B) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing PDCs disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,274,900; 4,268,276; 4,468,138; 4,738,322; 4,913,247; 5,016,718; 5,092,687; 5,120,327; 5,135,061; 5,154,245; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be opened ended and have the same meaning as the word "comprising" and variants thereof (e.g., "comprise" and "comprises").

What is claimed is:

1. A polycrystalline diamond compact, comprising:
a substrate; and
a polycrystalline diamond table including:
an upper surface;
at least one side surface;
an interfacial surface spaced from the upper surface and bonded to the substrate;
a plurality of bonded diamond grains defining a plurality of interstitial regions;
a first region extending inwardly from the upper surface and the at least one side surface, the first region including an alloy disposed in at least a portion of the plurality of interstitial regions in the first region, the alloy comprising at least one intermediate compound including at least one Group VIII metal and phosphorous, the phosphorous being distributed non-uniformly throughout at least the first region of the polycrystalline diamond table; and
a second region extending inwardly from the interfacial surface that is free of phosphorous.

2. The polycrystalline diamond compact of claim 1 wherein the alloy exhibits a bulk modulus that is less than that of the at least one Group VIII metal alone.

3. The polycrystalline diamond compact of claim 1 wherein the at least one Group VIII metal includes at least one of iron, cobalt, or nickel.

4. The polycrystalline diamond compact of claim 3 wherein the at least one Group VIII metal includes cobalt, and wherein the at least one intermediate compound includes $Co_2P$.

5. The polycrystalline diamond compact of claim 4 wherein the alloy includes cobalt, and wherein the second region includes cobalt therein and is substantially free of $Co_2P$.

6. The polycrystalline diamond compact of claim 1 wherein first region extends inwardly from at least a portion of one or more of the upper surface or the at least one side surface to a depth of at least about 250 μm.

7. The polycrystalline diamond compact of claim 1 wherein first region extends inwardly from the at least one side surface to form a generally annular first region extending peripherally about at least a portion of the second region.

8. The polycrystalline diamond compact of claim 1 wherein the polycrystalline diamond table includes a leached region extending inwardly from at least a portion of one or more of the upper surface or the at least one side surface to a distance of at least half the depth of the first region.

9. The polycrystalline diamond compact of claim 8 wherein the first region extends between at least a portion of the second region and the leached region.

10. The polycrystalline diamond compact of claim 8 wherein the leached region extends inwardly a distance from at least a portion of one or more of the upper surface or the at least one side surface to a depth of at least about 250 μm.

11. The polycrystalline diamond compact of claim 1, wherein:

the polycrystalline diamond table includes a chamfer extending between the upper surface and the at least one side surface; and the first region substantially contours the chamfer.

12. The polycrystalline diamond compact of claim 1 wherein the first region extends along substantially all of a total surface area of one or more of the at least one side surface or the upper surface of the polycrystalline diamond table.

13. The polycrystalline diamond compact of claim 1 wherein the first region extends along about 50% or more of a total surface area of one or more of the at least one side surface or the upper surface of the polycrystalline diamond table.

14. The polycrystalline diamond compact of claim 1 wherein the second region extends about the first region, and the first region extends inwardly from only a portion of the upper surface of the polycrystalline diamond table.

15. A rotary drill bit, comprising:

a bit body configured to engage a subterranean formation; and a plurality of polycrystalline diamond cutting elements affixed to the bit body, at least one of the polycrystalline diamond cutting elements including:

a substrate; and a polycrystalline diamond table including:

an upper surface;

at least one side surface;

an interfacial surface spaced from the upper surface and bonded to the substrate;

a plurality of bonded diamond grains defining a plurality of interstitial regions;

a first region extending inwardly from the upper surface and the at least one side surface, the first region including an alloy disposed in at least a portion of the plurality of interstitial regions in the first region, the alloy comprising at least one intermediate compound including at least one Group VIII metal and phosphorous, the phosphorous being distributed non-uniformly throughout at least the first region of the polycrystalline diamond table; and a second region extending inwardly from the interfacial surface that is free of phosphorous.

16. A method of fabricating a polycrystalline diamond compact, the method comprising:

providing an assembly including:

a substrate;

a polycrystalline diamond table bonded to the substrate, the polycrystalline diamond table including an upper surface, at least one side surface, an interfacial surface bonded to the substrate, and a plurality of bonded diamond grains defining a plurality of interstitial regions, at least a portion of the plurality of interstitial regions including at least one Group VIII metal disposed therein; and at least one material positioned adjacent to the polycrystalline diamond table, the at least one material including phosphorous; and subjecting the assembly to a heating process effective to at least partially alloy the at least one Group VIII metal with the phosphorous to form an alloy that includes at least one intermediate compound including the at least one Group VIII metal and the phosphorous, the polycrystalline diamond table including a first region extending inwardly from the upper surface and the at least one side surface that includes the at least one intermediate compound therein and a second region extending inwardly from the interfacial surface that is free of phosphorous;

wherein the phosphorous is distributed non-uniformly throughout at least the first region of the polycrystalline diamond table.

17. The method of claim 16 wherein providing an assembly includes positioning a layer including the at least one material adjacent to at least a portion of one or more of the upper surface or the at least one side surface.

18. The method of claim 16 wherein providing an assembly includes positioning a layer including the at least one material adjacent to more than about 50% of the surface area of one or more of the upper surface or the at least one side surface.

19. The method of claim 16 wherein the alloy exhibits a bulk modulus that is less than that of the at least one Group VIII alone.

20. The method of claim 16, further comprising leaching a region of the polycrystalline diamond table to a depth of at least about 250 μm from one or more of the upper surface or the at least one side surface.

21. The method of claim 20, wherein leaching occurs prior to forming the alloy.

22. The method of claim 20, wherein leaching a region of the polycrystalline diamond table removes at least some of the alloy.

23. The method of claim 16, wherein:

the assembly includes at least another material adjacent to the polycrystalline diamond table; and subjecting the assembly to a heating process includes forming another alloy including at least another intermediate compound.

24. The method of claim 16, wherein subjecting the assembly to a heating process includes subjecting the assembly to a high-temperature/high-pressure process.

25. The method of claim 16, wherein subjecting the assembly to a heating process is performed at ambient pressure.

26. A polycrystalline diamond compact, comprising:

a substrate; and a polycrystalline diamond table including:

an upper surface;

at least one side surface;

an interfacial surface spaced from the upper surface and bonded to the substrate;

a plurality of bonded diamond grains defining a plurality of interstitial regions;

a first region extending inwardly from the upper surface and the at least one side surface, the first region including an alloy disposed in at least a portion of the plurality of interstitial regions in the first region, the alloy comprising at least one intermediate compound including at least one Group VIII metal and phosphorous, wherein the at least one Group VIII metal includes cobalt and the at least one intermediate compound includes $Co_2P$; and a second region extending inwardly from the interfacial surface that is free of phosphorous.

27. The polycrystalline diamond compact of claim 26 wherein the phosphorous is distributed non-uniformly throughout at least the first region of the polycrystalline diamond table.

28. The polycrystalline diamond compact of claim 26 wherein the phosphorous is distributed uniformly throughout at least the first region of the polycrystalline diamond table.

29. The polycrystalline diamond compact of claim 26 wherein the alloy exhibits a bulk modulus that is less than that of the at least one Group VIII metal alone.

30. The polycrystalline diamond compact of claim 26 wherein the second region includes cobalt therein and is free of $Co_2P$.

31. The polycrystalline diamond compact of claim 26 wherein the first region extends inwardly from at least a portion of one or more of the upper surface or the at least one side surface to a depth of at least about 250 μm.

32. The polycrystalline diamond compact of claim 26 wherein first region extends inwardly from the at least one side surface to form a generally annular first region extending peripherally about at least a portion of the second region.

33. The polycrystalline diamond compact of claim 26, wherein:

the polycrystalline diamond table includes a chamfer extending between the upper surface and the at least one side surface; and the first region substantially contours the chamfer.

34. The polycrystalline diamond compact of claim 26 wherein the first region extends along substantially all of a total surface area of one or more of the at least one side surface or the upper surface of the polycrystalline diamond table.

35. The polycrystalline diamond compact of claim 26 wherein the first region extends along about 50% or more of a total surface area of one or more of the at least one side surface or the upper surface of the polycrystalline diamond table.

36. The polycrystalline diamond compact of claim 26 wherein the second region extends about the first region, and the first region extends inwardly from only a portion of the upper surface of the polycrystalline diamond table.

37. A polycrystalline diamond compact, comprising:

a substrate; and a polycrystalline diamond table including:

an upper surface;

at least one side surface;

an interfacial surface spaced from the upper surface and bonded to the substrate;

a plurality of bonded diamond grains defining a plurality of interstitial regions;

a first region extending inwardly from the upper surface and the at least one side surface, the first region including an alloy disposed in at least a portion of the plurality of interstitial regions in the first region, the alloy comprising at least one intermediate compound including at least one Group VIII metal and phosphorous, the phosphorous being distributed uniformly throughout at least the first region of the polycrystalline diamond table; and a second region extending inwardly from the interfacial surface that is free of phosphorous.

38. The polycrystalline diamond compact of claim 37 wherein the alloy exhibits a bulk modulus that is less than that of the at least one Group VIII metal alone.

39. The polycrystalline diamond compact of claim 37 wherein the second region includes cobalt therein and is free of $Co_2P$.

40. The polycrystalline diamond compact of claim 37 wherein the first region extends inwardly from at least a portion of one or more of the upper surface or the at least one side surface to a depth of at least about 250 μm.

41. The polycrystalline diamond compact of claim 37 wherein first region extends inwardly from the at least one side surface to form a generally annular first region extending peripherally about at least a portion of the second region.

42. The polycrystalline diamond compact of claim 37, wherein:

the polycrystalline diamond table includes a chamfer extending between the upper surface and the at least one side surface; and the first region substantially contours the chamfer.

43. The polycrystalline diamond compact of claim 37 wherein the first region extends along substantially all of a total surface area of one or more of the at least one side surface or the upper surface of the polycrystalline diamond table.

44. The polycrystalline diamond compact of claim 37 wherein the first region extends along about 50% or more of a total surface area of one or more of the at least one side surface or the upper surface of the polycrystalline diamond table.

45. The polycrystalline diamond compact of claim 37 wherein the second region extends about the first region, and the first region extends inwardly from only a portion of the upper surface of the polycrystalline diamond table.

46. A rotary drill bit, comprising:

a bit body configured to engage a subterranean formation; and a plurality of polycrystalline diamond cutting elements affixed to the bit body, at least one of the polycrystalline diamond cutting elements including:

a substrate; and a polycrystalline diamond table including:

an upper surface;

at least one side surface;

an interfacial surface spaced from the upper surface and bonded to the substrate;

a plurality of bonded diamond grains defining a plurality of interstitial regions;

a first region extending inwardly from the upper surface and the at least one side surface, the first region including an alloy disposed in at least a portion of the plurality of interstitial regions in the first region, the alloy comprising at least one intermediate compound including at least one Group VIII metal and phosphorous, wherein the at least one Group VIII metal includes cobalt and the at least one intermediate compound includes $Co_2P$; and a second region extending inwardly from the interfacial surface that is free of phosphorous.

* * * * *